US007709174B2

(12) United States Patent
Sugimoto et al.

(10) Patent No.: US 7,709,174 B2
(45) Date of Patent: May 4, 2010

(54) TONER, METHOD OF PREPARING THE TONER, AND DEVELOPER, IMAGE FORMING METHOD, IMAGE FORMING APPARATUS, AND PROCESS CARTRIDGE USING THE TONER

(75) Inventors: Tsuyoshi Sugimoto, Yokohama (JP); Hiroshi Yamashita, Numazu (JP); Ryota Inoue, Mishima (JP); Yoshihiro Moriya, Numazu (JP); Shinichi Wakamatsu, Numazu (JP); Akihiro Kotsugai, Numazu (JP)

(73) Assignee: Ricoh Company Limited, Tokyo (JP)

( * ) Notice: Subject to any disclaimer, the term of this patent is extended or adjusted under 35 U.S.C. 154(b) by 684 days.

(21) Appl. No.: 11/611,165

(22) Filed: Dec. 15, 2006

(65) Prior Publication Data

US 2007/0141500 A1 Jun. 21, 2007

(30) Foreign Application Priority Data

| | | |
|---|---|---|
| Dec. 15, 2005 | (JP) | 2005-361882 |
| Aug. 25, 2006 | (JP) | 2006-229027 |
| Sep. 6, 2006 | (JP) | 2006-241848 |
| Dec. 15, 2006 | (JP) | 2006-337790 |

(51) Int. Cl.
*G03G 9/00* (2006.01)

(52) U.S. Cl. ..... 430/110.2; 430/110.1; 430/110.3; 430/109.1; 430/109.4; 430/137.1; 399/252

(58) Field of Classification Search ..... 430/110.2, 430/110.1, 110.3, 109.1, 109.4, 137.1; 399/252
See application file for complete search history.

(56) References Cited

U.S. PATENT DOCUMENTS

| | | | | |
|---|---|---|---|---|
| 4,661,430 | A * | 4/1987 | Wakamiya et al. | 430/122.8 |
| 4,980,257 | A * | 12/1990 | Anno et al. | 430/110.2 |
| 2005/0058927 | A1 * | 3/2005 | Mikuriya et al. | 430/110.2 |
| 2006/0099529 | A1 | 5/2006 | Tanaka et al. | |
| 2006/0127788 | A1 | 6/2006 | Yamashita et al. | |
| 2006/0160011 | A1 | 7/2006 | Inoue et al. | |

FOREIGN PATENT DOCUMENTS

| | | |
|---|---|---|
| JP | 63-131149 | 6/1988 |
| JP | 02-000880 | 1/1990 |
| JP | 02-208661 | 8/1990 |

(Continued)

OTHER PUBLICATIONS

U.S. Appl. No. 12/046,728, filed Mar. 12, 2008, Ishii, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

A toner is provided including a colorant; a first binder resin; and a second binder resin, wherein an amount of the first binder resin and an amount of the second binder resin are phase separated from each other in the toner, and wherein a phase of the first binder resin is partially or completely covered with a phase of the second binder resin; and a method of preparing the toner, and a developer, an image forming method, an image forming apparatus, and a process cartridge using the toner.

20 Claims, 6 Drawing Sheets

FOREIGN PATENT DOCUMENTS

| | | |
|---|---|---|
| JP | 02-259657 | 10/1990 |
| JP | 03-228066 | 10/1991 |
| JP | 04-337741 | 11/1992 |
| JP | 09-258474 | 10/1997 |
| JP | 09-319144 | 12/1997 |
| JP | 11-174732 | 7/1999 |
| JP | 11-231572 | 8/1999 |
| JP | 2000-347455 | 12/2000 |
| JP | 2002-028488 | 1/2002 |
| JP | 2002-229251 | 8/2002 |
| JP | 2003-140381 | 5/2003 |
| JP | 2004-004506 | 1/2004 |
| JP | 2005-017773 | 1/2005 |
| JP | 2005-091706 | 4/2005 |
| JP | 2005-181835 | 7/2005 |
| JP | 2005-215491 | 8/2005 |
| JP | 2005-274964 | 10/2005 |
| JP | 2005-301261 | 10/2005 |
| JP | 2006-065001 | 3/2006 |

OTHER PUBLICATIONS

U.S. Appl. No. 11/206,128, filed Aug. 18, 2005, Yamashita, et al.
U.S. Appl. No. 12/248,313, filed Oct. 9, 2008, Sugimoto, et al.

* cited by examiner

TONER, METHOD OF PREPARING THE TONER, AND DEVELOPER, IMAGE FORMING METHOD, IMAGE FORMING APPARATUS, AND PROCESS CARTRIDGE USING THE TONER

BACKGROUND OF THE INVENTION

1. Field of the Invention

The present invention relates to a toner for use in electrophotography and a preparing method thereof. In addition, the present invention also relates to a developer, an image forming method, an image forming apparatus, and a process cartridge using the toner.

2. Discussion of the Background

In electrophotography, an image is typically formed as follows:

(1) charging the surface of a photoreceptor serving as an image bearing member by electric discharge (i.e., charging process);

(2) irradiating the charged surface of the photoreceptor to form an electrostatic latent image thereon (i.e., irradiating process);

(3) developing the electrostatic latent image formed on the photoreceptor by supplying a toner thereto to form a toner image thereon (i.e., developing process);

(4) transferring the toner image formed on the photoreceptor onto the surface of a transfer medium (i.e., transfer process);

(5) fixing the toner image formed on the surface of the transfer medium thereto (i.e., fixing process); and (6) removing toner particles remaining on the surface of the image bearing member after the transfer process (i.e., cleaning process).

Electrophotographic full-color image forming apparatuses have been widely used recently. Since digital images can be easily obtained, printed images thereof are required to have much higher definition. In attempting to improve resolution and gradient of the printed images, a toner, which visualize a latent image, is improved to be much more spherical in shape and smaller in size. Since pulverized toners are limited in shape and size, polymerized toners such as suspension polymerization toners, emulsion aggregation toners, and dispersion polymerization toners, have been used recently.

As disclosed in Japanese Patent No. (hereinafter referred to as JP) 3486707, a polymerized toner has an advantage in producing high definition images. However, such a toner has a drawback of increasing a non-electric adherence between a photoreceptor because of having a small particle diameter, and therefore toner particles tend to remain on the photoreceptor and form a toner film thereon after the transfer process. The toner has another drawback of passing through a cleaning blade because of having a spherical shape.

In electrophotography, a toner is required to have separativeness (hereinafter referred to as hot offset resistance) in that the toner is separated from a heating member such as a heat roller in a fixing process using a contact heating method. In attempting to improve hot offset resistance, JP 3640918 discloses a toner including a modified polyester resin prepared by reacting a precursor of the polyester resin, prepared by a dissolution suspension method.

In recent attempt to improve energy conservation in electrophotography, a toner is required to have low-temperature fixability in that the toner can sufficiently melt even under low fixing temperatures. For example, a toner having a core-shell structure, in which the core having low-temperature fixability is covered with the shell having thermal resistance, is proposed. Such a toner having a core-shell structure can be prepared by a phase separation method, a salting-out aggregation method, an in-situ polymerization method, a spray dry method, an interfacial polymerization method, etc.

JP 3786107 discloses a toner having a core-shell structure in which the core formed by aggregating and fusing a first particulate resin and a colorant is covered with the shell formed by aggregating and fusing a second particulate resin which is stably dispersed in an aqueous medium.

Published unexamined Japanese Patent Application No. (hereinafter referred to as JP-A) 2004-004506 discloses a toner having a core-shell structure prepared as follows. Droplets of a monomer for preparing the shell, which have a smaller average particle diameter than core particles, are added to a suspension liquid containing core particles, and then the mixture is subjected to a dispersion treatment using an ultrasonic emulsifier. A water-soluble polymerization initiator is further added thereto so that the monomer is polymerized at the surface of the core particles.

JP 3305998 discloses a toner having a core-shell structure in which the core including a colorant and a thermoplastic resin prepared by polymerizing a monomer is covered with the shell formed by seed polymerizing a second monomer.

JP-A 02-259657 discloses a method of preparing an encapsulated toner. In this method, cross-linked resin particles prepared by a suspension-polymerization are added to a solution including a monomer for encapsulation, and then a poor solvent (in which the monomer is not dissolved) is added thereto.

Since the above-mentioned methods include two processes of preparing a core particle and forming a shell, these methods tend to be complicated. Since the shell is formed by a polymerization reaction at a time of preparing the core particle, it is difficult to grasp the resin properties of the shell before the resultant toner is prepared. There is a possibility that the monomer for preparing the shell comes into and/or remains inside the core particle. When the monomer is polymerized inside the core particle, low-temperature fixability of the core particle deteriorates.

The same can be said for a toner disclosed in JP-A 2005-301261 having a shell including a modified polyester resin prepared by reacting a polyester precursor, which is prepared by a dissolution suspension method. It is difficult to grasp the resin properties of the shell before the resultant toner is prepared. In addition, the kind of the modified resin that can be used is limited.

In general, electrophotographic full-color images have poor color reproducibility compared with those produced by silver halide photography and printing, and the image quality thereof does not reach the level satisfying the users' eyes.

In order to raise the electrophotographic full-color image quality to the level that of silver halide photography and printing, a toner for use in electrophotography needs to include a colorant having good color reproducibility and high coloring power. Conventionally, pigments are generally used as colorants. The pigments have better light resistance and heat resistance compared with dyes, but most of the pigments tend to have poor dispersibility in the resultant toner, and therefore the kind of the pigment that can be use for the toner is limited. Therefore, full-color images produced with such a conventional toner have poor color reproducibility, coloring power, transparency, image definition, and image density.

In attempting to solve the above problems, a technique in which the content of a colorant is increased in a toner so that the coloring power thereof is increased is proposed. However, when the content of the colorant is increased, the number of the colorant particles present at the surface of the toner particles increases, and therefore chargeability, developability, and transferability of the toner deteriorate.

JP-A 11-231572 discloses a toner in which a colorant is highly dispersed with a polymer dispersant and a synergist which interacts with both the colorant and the polymer dispersant. However, the synergist tends to deteriorate chargeability, developability, and transferability of the resultant toner.

Toners for use in electrophotography are simultaneously required to have good ability to produce high definition images, color reproducibility, transferability, fixability, preservability, and cleanability, each of which is difficult to satisfy at the same time. Various attempts have been made to respond to the above requirement for a long period of the time. It is considered that the above requirement can be achieved by a toner having an inner layer and an outer layer, wherein the function of the inner layer (e.g., coloring ability, low-temperature fixability) and that of the outer layer (e.g., transferability, fluidity, cleanability, toner filming resistance) are separated.

In attempting to simultaneously improve both thermostable preservability and fixability, a toner having a core-shell structure in which the outer layer of the toner is formed of a shell having high heat resistance is proposed. However, the thermostable preservability of the toner depends on the thickness of the shell. When the thickness is too large, the shell inhibits the melting of the core when fixed, and therefore a wax (i.e., a release agent for separating from a fixing roller) cannot sufficiently exude therefrom. When the thickness is too small, the shell cannot sufficiently exert its protection effect.

JP-A 2006-065001 discloses a toner having a core-shell structure in which the shell includes a cellulose derivative having a micro-porous structure. When the toner is fixed, the core having a low glass-transition temperature expands and spreads out the shell. Since the shell has a micro-porous structure, the expansion force of the core concentrates on holes of the shell, and therefore the shell is easily cracked and the core is easily exposed. It is described therein that such a toner has both thermostable preservability and fixability. However, the shell inhibits the melting of the core when fixed, and therefore the fixability of the toner is not sufficient.

The final shape of the above-mentioned toners having a core-shell structure basically depends on that of the core. The shell does not influence the toner shape, and is not required to impart transferability and cleanability to the toner by changing the toner shape. However, cleanability, fluidity, and transferability of a toner can be improved when the toner has an irregular shape reasonably far from a true spherical shape.

In attempting to improve cleanability, JP-A 2005-274964 and JPs 2844795 and 2762507 have disclosed toners having core-shell structures in which the shells have projections. Since these toners are prepared by methods including extra processes of forming the projections, there is a drawback that the manufacturing cost thereof increases.

JPs 2750853 and 2838410 have disclosed toners in which small resin particles are mechanically buried in mother resin particles. The small resin particles form a discontinuous independent resin phase on the mother resin particles, and the resin phase impart good thermostable preservability to the resultant toner without deteriorating fixability of the mother resin particles. However, when projections are formed by mechanical or thermal methods as mentioned above, the projections easily peel off from the surface of the mother particles upon application of mechanical stress and cannot be sufficiently fixed thereto.

JP-A 2005-17773 discloses a particle in which projections are chemically bounded to the surface of a mother particle. In particular, the mother particle having functional groups is immersed in or mixed with an organic compound such as a carbodiimide compound, an epoxy compound, and an oxazoline compound so that projections are chemically bounded to the surface of the mother particle. In this case, the particle has a stiff structure because the projections are chemically bounded to the mother particle and impregnated therein. However, there is a drawback that the particle is prepared by a complicated method including a process of forming the mother particle, and an extra process of forming projections on the mother particle by mixing with a medium in which an organic compound having a reactive group capable of reacting with functional groups of the mother particle is dissolved or dispersed therein. No mention is made of whether the particle has functions of a toner (such as chargeability and thermal property). In addition, no mention is made of how the size of the projection (i.e., the degree of the exposure of the mother particle) effects on toner properties.

Because of these reasons, a needs exist for a toner which can produce high-quality full-color images comparable to those produced by silver halide photography or printing.

SUMMARY OF THE INVENTION

Accordingly, an object of the present invention is to provide a toner and a developer which can produce high quality and high definition images having good color reproducibility, image density, and transparency, while having a good combination of toner properties such as aggregation resistance, chargeability, fluidity, transferability, and fixability.

Another object of the present invention is to provide a method of preparing the toner.

Further object of the present invention is to provide an image forming method, an image forming apparatus, and a process cartridge which can produce high quality images by using the above toner.

These and other objects of the present invention, either individually or in combinations thereof, as hereinafter will become more readily apparent can be attained by a toner, comprising:

a colorant;

a first binder resin; and a second binder resin, wherein an amount of the first binder resin and an amount of the second binder resin are phase separated from each other in the toner, and wherein a phase of the first binder resin is partially or completely covered with a phase of the second binder resin;

and a method of preparing the toner; and a developer, an image forming method, an image forming apparatus, and a process cartridge using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1A:
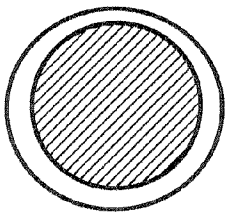
FIGS. 1A to 1E are schematic views illustrating embodiments of the toners of the present invention and comparative toners.

The toner of the present invention is prepared by a dissolution suspension method comprising:

dissolving or dispersing toner constituents comprising a first binder resin and a second binder resin, which are incompatible with each other, in a solvent to prepare a toner constituent solution or dispersion; and phase separating the first binder resin and the second binder resin in succeeding granulating, solvent-removal, washing, and drying processes.

The first and second binder resins are completely or mostly compatible with each other in the toner constituent solution or dispersion and form a single phase, because the solvent mediates the first and second binder resins. After the solvent is removed from the granulated particle, the first and second binder resins are phase separated in the particle and the second binder resin phase completely or partially covers the surface of the first binder resin phase. When the first binder resin phase and other constituents included therein have functions desired for the inner layer of the toner, and the second binder resin phase and other constituents included therein have functions desired for the outer layer of the toner, i.e., the functions of the inner and outer layers of the toner are separated, the resultant toner has a good combination of various toner properties.

When a toner has a core-shell structure in which the first binder resin phase is completely covered with the second binder resin phase, the second binder resin phase can function as a charge protective layer and a heat protective layer, for example.

When the first binder resin phase (i.e., mother particle) is covered with projections formed of the second binder resin phase, an appropriate amount of the first binder resin phase is exposed at the surface of the resultant toner compared with the above toner having the core-shell structure. Therefore, the mother particles (i.e., cores) can be fused with each other without being inhibited by the projections (i.e., shells) when fixed. Since the second binder resin phase forms discontinuous independent projections on the surface of the mother particles, the projections act as spacers and prevent the mother particles from contacting each other when preserved, and therefore thermostable preservability of the toner improves. Such a toner has an irregular shape reasonably far from a true spherical shape, compared with a toner having a complete core-shell structure. Since the toner contacts a photoreceptor via the projections, the contact area between the toner and the photoreceptor decreases, and therefore transferability and cleanability of the toner improves. Since the projections formed of the second binder resin phase are firmly bound to the mother particles, the toner has mechanical-stress durability.

Other toner constituents can be selectively contained in each oh the resin phases due to a difference in compatibility (i.e., wetting property) between a toner constituent and a resin.

For example, when the first resin phase selectively contains a colorant, the colorant does not present at the surface of the toner, and therefore the colorant does not deteriorate chargeability of the toner and is prevented from forming colorant films on image bearing members. Other toner constituents such as a charge controlling agent and a release agent can also be arbitrarily contained in the inner or outer layers of the toner according to the demands of the image forming process used.

The toner of the present invention comprises a first binder resin, a second binder resin, and a colorant, and optionally includes a release agent, a charge controlling agent, etc., if desired. The first and second binder resins are phase separated in the toner preparing process, and as a result, the first binder resin is partially or completely covered with the second binder resin.

The shape of the resultant toner largely depends on the compatibility between the first and second binder resins in an organic solvent and that in the granulated particles after the organic solvent is removed therefrom. Other than the compatibility, the mixing ratio among the first binder resin and the second binder resin and the organic solvent, shearing force applied to the mixture when granulated, viscosities of an aqueous medium and an organic medium used, etc., also influence the toner shape.

The toner shape and the compatibility between the first and second binder resins with and without an organic solvent will be explained in detail below.

Core-shell Type

When the first and second binder resins satisfy the following conditions, the first and second binder resins tend to be phase separated in one toner particle and form a core-shell structure.

(1) When a mixture of the first and second binder resins, which is mixed at the same mixing ratio as the granulated toner, is dissolved in an organic solvent at the same concentration as the granulation process, a single phase is formed in the solution.

(2) When the organic solvent is removed from the above solution, the first and second resins are incompatible.

A first binder resin and a second binder resin, which are incompatible when an organic solvent is not present, and which form a single phase when dissolved in an organic solvent at the same concentration as the granulation process, do not form a clear interface therebetween in the solution, because there are reasonable chemical and structural interactions therebetween. When a solution or a dispersion (hereinafter referred to as an oil phase) in which such a first binder resin and a second binder resin are dissolved or dispersed is emulsified or dispersed and then the organic solvent is removed therefrom, the first and second binder resins are phase separated while forming a clear interface therebetween. In this case, a toner having a core-shell structure can be prepared. An embodiment of such a toner is illustrated in FIG. 1A.

Figure 1B:
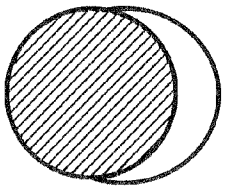
Figure 1C:
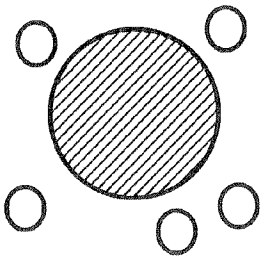

When a first and a second binder resins form independent two phases when dissolved in an organic solvent, the interaction therebetween is so small that the resins form a structure in which the contact area therebetween is as small as possible at a time of phase separation in the granulation and solvent removal processes. In other words, a toner having a structure in which a part of a mother particle formed of the first binder resin is covered with the second binder resin is formed, and a toner having a complete core-shell structure is hardly obtained. An embodiment of such a toner is illustrated in FIG. 1B. In some extreme cases, the second binder resin releases from mother particles, and particles consisting of the second binder resin are separately produced. An embodiment of such a toner is illustrated in FIG. 1C.

Figure 1D:
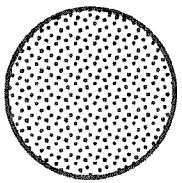

On the other hand, when the first and second binder resins form one phase when dissolved in an organic solvent, and the phase is not separated even after the organic solvent is removed, the chemical and structural interactions therebetween are so large that the resins are not phase separated even in the granulation and solvent removal processes. In this case, a toner having a core-shell structure cannot be obtained. An embodiment of such a toner is illustrated in FIG. 1D.

For the above reasons, the toner of the present invention having a core-shell structure is prepared using two resins which are incompatible with each other while having reasonable chemical and structural interactions therebetween. The surface of the core formed of the first binder resin is covered with the second binder resin due to the interaction therebetween, in the granulation and solvent removal processes.

A condition "a first binder resin and a second binder resin form one phase when dissolved in an organic solvent" is defined as the condition that an organic solvent solution in which the two resins are dissolved are not phase separated and an interface is not clearly observed therein, when the organic solvent solution is left at rest. Specifically, the two resins are mixed at the same mixing ratio as the granulated toner and evenly ground with a mortar, and then the mixture is dissolved in the organic solvent used for the granulation at the same concentration as the granulation process. It is preferable that an interface is not clearly observed even after the organic solvent solution is agitated for 10 hours using a paint shaker and then left at rest for 12 hours. When the organic solvent solution has a transmittance of 70% or more at a wavelength of 550 nm, immediately after being subjected to the agitation with the paint shaker, it means that two resins have good solubility to the organic solvent and the interaction between the two resins are well. The transmittance can be measured by, for example, a UV-VIS spectrophotometer UV-3100 (manufactured by Shimadzu Corporation).

The toner preferably includes the second binder resin in an amount of from 5 to 50% by weight based on total weight of the toner. When the amount is too small, the resultant shell layer is too thin, and therefore the shell layer cannot function as a heat-resistant protective layer and a charge retention layer. When the amount is too large, the phase separation is accelerated, and therefore the second binder resin tends to release from toner particles. In some cases, the core cannot exert its effect, and therefore the resultant toner cannot have desired toner properties.

Projection Type

Figure 1E:
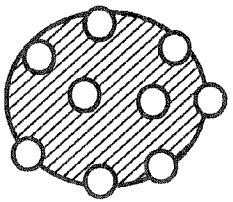
Figure 1E:
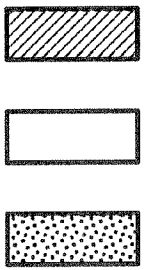
Figure 2A:
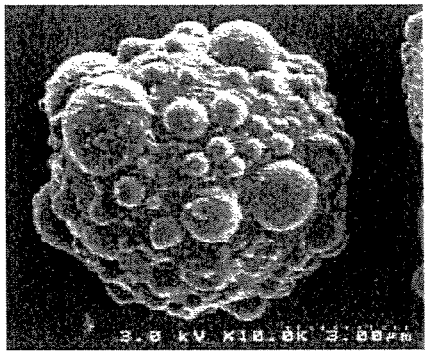
FIGS. 2A to 2D are images of the toner of the present invention obtained by a scanning electron microscope (SEM)
Figure 2B:
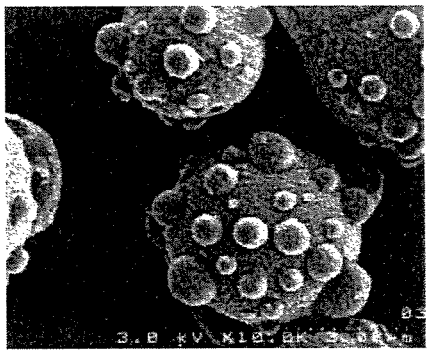
Figure 2C:
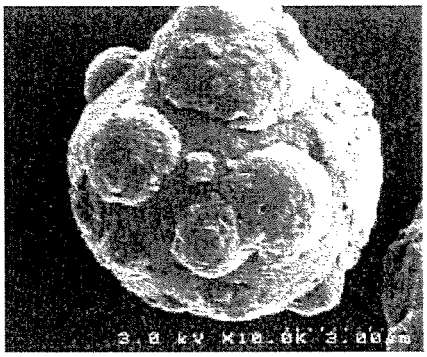
Figure 2D:
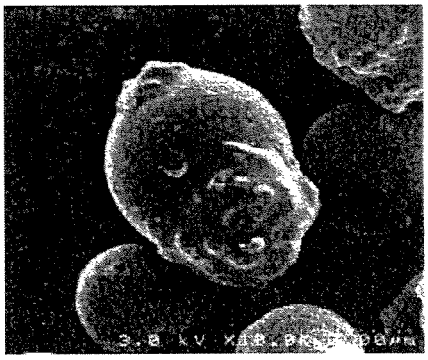

When the first and second resins have less compatibility compared with those forming a core-shell structure, the resultant toner tends to have a structure in which the first binder resin is partially covered with the second binder resin (FIG. 1B) or in which the first binder resin is covered with projections formed of the second binder resin (FIG. 1E). FIGS. 2A to 2D are images of the toners of the present invention obtained by a scanning electron microscope (SEM). As observed in the SEM images, various types of projections can be formed, and the projections can be controlled to have desired shape. However, the toner shape can also be controlled by factors other than the compatibility between the two resins such as the viscosities of the oil phase and the aqueous phase, and the shearing force applied in the granulation process, and is not uniquely defined only by the compatibility between the two resins.

The first binder resin forming mother particles and the second binder resin forming discontinuous independent projections on the surface of the mother particles are preferably incompatible with each other. In particular, the incompatibility is determined as follows.

Equal amounts of the first and second binder resins are mixed and evenly ground with a mortar, and then the resin mixture is dissolved in ethyl acetate so that the resultant resin solution has a concentration of 50% by weight. The resin solution is agitated for 10 hours using a paint shaker, and then subjected to a measurement of transmittance at a wavelength of 550 nm. The transmittance can be measured by, for example, a UV-VIS spectrophotometer UV-3100 (manufactured by Shimadzu Corporation).

When the two resins are incompatible, white turbidity is observed in the resin solution when agitated. If the transmittance thereof is from 0 to 70%, the white turbidity can be visually observed and therefore incompatibility can be visually checked.

When the transmittance is 70% or more, the incompatibility between the two resins is weak. If such resins are used for the present invention, the second binder resin may form a big domain thereof on the surface of the mother particles (i.e., the first binder resin), and therefore the exposed portion of the mother particles decreases. Since the second binder resin does not form projections, toner properties such as cleanability and fluidity cannot be imparted to the resultant toner.

(Measurement of Exposure Ratio of Mother Particle)

Methods of measuring the exposure ratio of a mother particle (i.e., the first binder resin) at the surface of a toner particle are not particularly limited. The following is an example of the above method.

Figure 3:
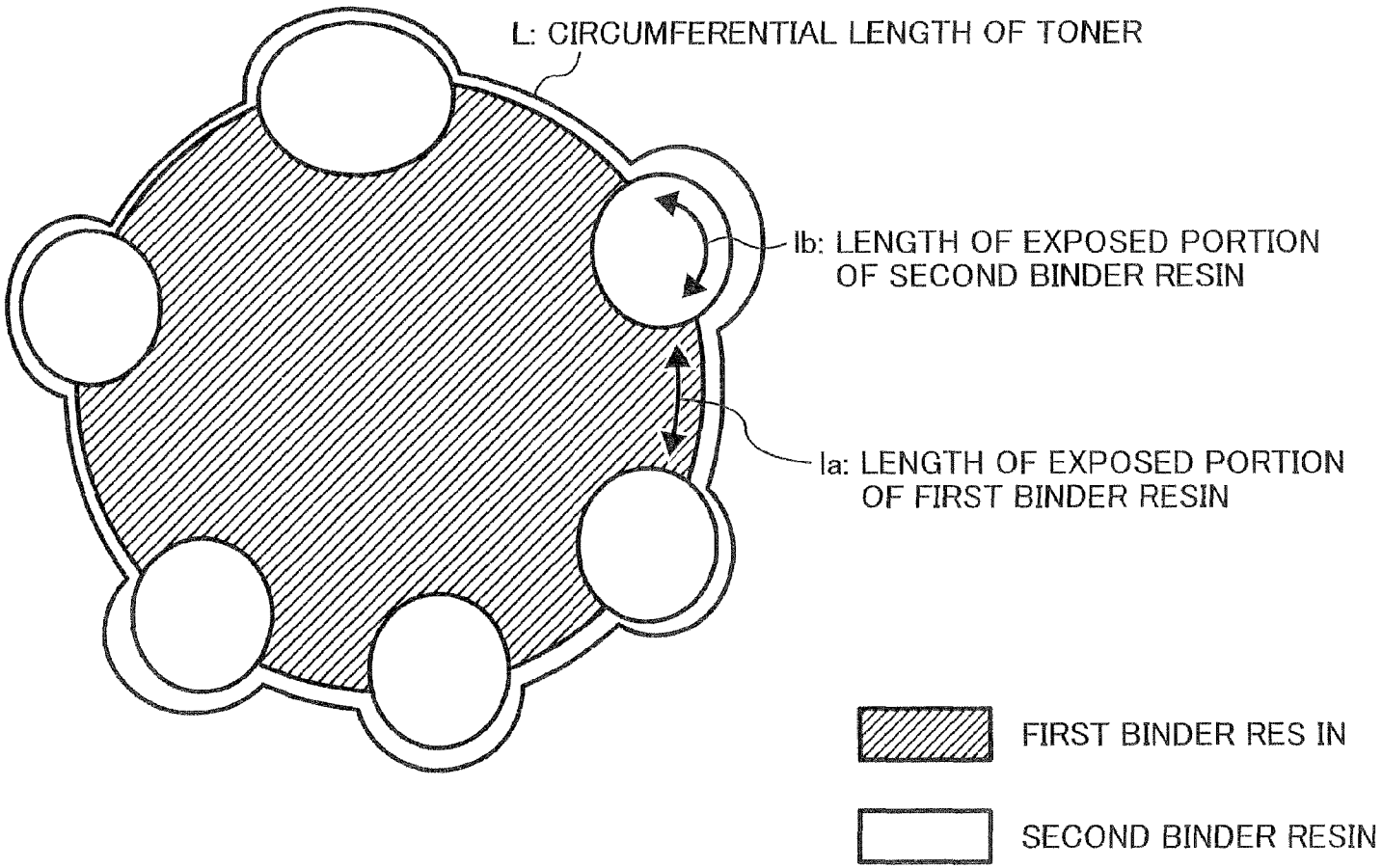
FIG. 3 is a schematic view illustrating an embodiment of a cross section of the toner of the present invention.

FIG. 3 is a schematic view illustrating a cross-section obtained by a transmission electron microscope (TEM) of an embodiment of the toner particle of the present invention. L represents a circumferential length of a toner particle, la represents a length of an exposed portion of the first binder resin, and lb represents a length of an exposed portion of the second binder resin. The exposure ratio of the first binder resin is calculated by the following equation:

$$R=(La/L)\times 100$$

wherein R represents an exposure ratio of the first binder resin, La represents a sum of la (i.e., $La=\Sigma la$), and L represents a circumferential length of a toner particle.

A cross-sectional image of a toner can be obtained by a TEM as follows. A toner is dispersed in an epoxy resin which can be hardened at room temperature, and then the mixture is exposed to an atmosphere having a temperature of 40° C. for 2 days so that the epoxy resin is hardened. The hardened material is stained with ruthenium tetroxide, and then cut into ultrathin sections using a microtome equipped with a diamond knife. The thus prepared ultrathin section is observed by a transmission electron microscope (TEM) to obtain toner section images, and the average exposure ratio of 50 randomly selected toner particles is determined from the section images.

In the present invention, the first binder resin preferably has an exposure ratio of from 20 to 70%. When the exposure ratio is too small, too large a part of the first binder resin is covered with the second binder resin, and therefore the second binder resin inhibits the first binder resin (i.e., mother particle) from melting and fusing when fixed. When the exposure ratio is too large, too small a part of the first binder resin is covered with the second binder resin, and therefore mother particles (i.e., first binder resins) tend to contact with each other when preserved, resulting in deterioration of thermostable preservability of the toner.

The above-mentioned la and lb preferably have the following relationships:

$$0.01<la(av)/L<0.3$$

$$0.01<lb(av)/L<0.5$$

wherein la(av) represents an average of la, lb(av) represents an average of lb, and L represents a circumferential length of a toner particle.

When la(av)/L is too large or lb(av)/L is too small, the first binder resin is largely exposed at the surface of the toner, and therefore mother particles (i.e., first binder resins) tend to contact with each other when preserved, resulting in deterioration of thermostable preservability of the toner. When la(av)/L is too small or lb(av)/L is too large, discontinuous independent projections formed of the second binder resin are largely exposed at the surface of the toner, and therefore the second binder resin inhibits the first binder resin (i.e., mother particle) from melting and fusing when fixed.

The projections formed of the second binder resin preferably have a height of from 0.1 to 2 μm measured from the surface of the mother particle. When the height is too small, the projections do not function as spacers, and therefore the resultant toner cannot have desired thermostable preservability and cleanability. When the height is too large, fixability of the resultant toner deteriorates, and the projections have poor strength for mechanical stresses.

When the toner has projections, the second binder resin preferably comprises a styrene-acrylic copolymer having a quaternary ammonium salt unit obtained by quaternizing a dialkylaminoalkyl(meth)acrylate. In this case, the second binder resin reasonably tends to be present on the surface of the mother particle, and therefore reasonable amount of the first binder resin exposes at the surface of the toner particle.

The toner preferably includes the second binder resin in an amount of from 5 to 50% by weight based on total weight of the toner. When the amount is too small, the second binder resin cannot form enough projections on the surface of the mother particle, and therefore the resultant toner cannot have desired transferability, cleanability, and preservability. When the amount is too large, the phase separation between the first and second binder resins, which are incompatible with each other, is accelerated, and therefore the second binder resin tends to release from the mother particle when the resultant toner is granulated.

Binder Resin

The binder resin for use in the toner of the present invention comprises two or more kinds of resins, and is not particularly limited. Any known binder resins such as polyester resins, silicone resins, styrene-acrylic resins, styrene resins, acrylic resins, epoxy resins, diene resins, phenol resins, terpene resins, coumarin resins, amide resins, amideimide resins, butyral resins, urethane resins, and ethylene-vinyl acetate resins can be used.

(First Binder Resin)

The first binder resin is required to sharply melt when the toner is fixed so that the surface of the resultant image is smoothened. For this purpose, polyester resins are preferably used because of having good flexibility even if the molecular weight thereof is low. Other resins can be used in combination with the polyester resins.

The polyester resin for use in the present invention is prepared from one or more polyol having the following formula (1), and one or more polycarboxylic acid having the following formula (2):

$$A\text{-}(OH)_m \quad (1)$$

$$B\text{-}(COOH)_n \quad (2)$$

wherein each of A and B independently represents an alkyl group, an alkylene group, an aromatic group which may have a substituent group, or a heterocyclic aromatic group, having 1 to 20 carbon atoms; and each of m and n independently represents an integer of from 2 to 4.

Specific examples of the polyols having the formula (1) include, but are not limited to, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, propylene oxide adducts of hydrogenated bisphenol A, etc.

Specific examples of the polycarboxylic acids having the formula (2) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, cyclohexanedicarboxylic acid, cyclohexenedicarboxylic acid, butanetetracarboxylic acid, diphenylsulfonetetracaboxylic acid, ethylene glycol (trimellitic acid), etc.

The toner preferably includes the first binder resin in an amount of from 50 to 95% by weight based on total weight of the toner. When the amount is too small, the resultant toner has poor low-temperature fixability.

(Second Binder Resin)

The second binder resin for use in the present invention is not particularly limited, but preferably has higher charging ability compared with the first binder resin. In view of imparting high chargeability to the resultant toner, silicone resins and styrene-acrylic resins are preferably used as the second binder resin. In this case, it is relatively easy to improve chargeability of the resultant toner, and as a result, developability and transferability thereof also improve.

As the silicone resins, resins having a three-dimensional network structure consisting of the following unit (3) having a siloxane bond are preferably used:

$$R_kSiO— \quad (3)$$

wherein R represents an alkyl group (such as methyl group and ethyl group) or an aromatic group (such as phenyl group)

(in these cases the formula (3) represents a straight silicone resin), which may be modified with an alkyd, a polyester, an epoxy, or an acrylic resins; and k represents an integer of from 1 to 3.

Specific examples of such silicone resins include, but are not limited to, a silicone resin having the following formula (4):

$$Me_3SiO\text{-}(Me_2SiO)_s\text{—}SiOMe_3 \quad (4)$$

and silicone resins including a dimethyl silicone (-$(Me_2SiO)_s$—), a diphenyl silicone (—$(\phi_2SiO)_s$—), and a phenylmethyl silicone (-$(Me\phi SiO)_s$—) skeletons (or repeating units), wherein s represents the number of the repeating unit, Me represents an alkyl group or an aromatic group, which may be modified with an alkyd, a polyester, an epoxy, or an acrylic resins.

Specific examples of the styrene-acrylic resins include, but are not limited to, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-acrylonitrile-indene copolymers, etc. Specific examples of copolymers of styrene and another resin include, but are not limited to, styrene-p-chlorostyrene copolymers, styrene-propylene copolymers, styrene-vinyltoluene copolymers, styrene-vinylnaphthalene copolymers, styrene-vinyl methyl ketone copolymers, styrene-butadiene copolymers, styrene-isoprene copolymers, styrene-maleic acid copolymers, styrene-maleate copolymers, etc.

The above resins can be optionally copolymerized with a monomer or an oligomer having a functional group such as carboxyl group, hydroxyl group, and quaternary ammonium salt, if desired. By changing the mixing ratio and the molecular weight of such a monomer or an oligomer, the compatibility of the second binder resin with the first binder resin can be controlled.

(Method of Discriminating First and Second Resin Phases)

The method of discriminating the first and second binder resin phases in a toner particle is not particularly limited, and any known methods can be used. For example, whether the first and second binder resin phases are phase separated in a toner particle can be simply determined by directly observing the toner particle with an optical microscope. When the second binder resin phase has a relatively large domain particle diameter (about 1 μm or more), a phase separated structure in a toner particle can be directly observed with an optical microscope. When the second binder resin phase has too small a domain particle diameter, it is difficult to discriminate it with an optical microscope. In this case, a toner is embedded in an epoxy resin so as to be cut into an ultrathin section having a thickness of about 100 μm. The ultrathin section is then stained with a heavy metal oxide such as ruthenium tetroxide, and then observed with a transmission electron microscope (TEM) at a magnification of 10,000 times so that toner section images are photographed. Since the heavy metal oxide stains a resin depending on the composition thereof, different resins can be discriminated by the staining. Whether the first and second binder resin phases are phase separated in a toner particle can be determined by evaluating the toner section photographs.

Average Circularity

The circularity of a particle is determined by the following equation:

$$C=Lo/L$$

wherein C represents the circularity, Lo represents the length of the circumference of a circle having the same area as that of the image of the particle and L represents the peripheral length of the image of the particle.

The average circularity of a toner can be determined using a flow-type particle image analyzer FPIA-2000 (manufactured by Sysmex Corp.). Specifically, the method is as follows:

(1) 0.1 g to 0.5 g of a sample to be measured is mixed with 100 ml to 150 ml of water, in which solid impurities are removed, including 0.1 ml to 0.5 ml of a dispersant (i.e., a surfactant); and (2) the mixture is dispersed using an ultrasonic dispersing machine for about 1 to 3 minutes to prepare a suspension including particles of 3,000 to 10,000 per micro-liter of the suspension.

The toner of the present invention preferably has an average circularity of from 0.920 to 0.970. In this case, the toner has a good combination of dot reproducibility, developability, transferability and cleanability.

Other Components

The toner of the present invention may include other components such as a colorant, a release agent, a charge controlling agent, a particulate inorganic material, a fluidizer, a cleanability improving agent, a magnetic material, and a metal soap.

(Colorant)

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The toner preferably includes a colorant in an amount of from 1 to 15% by weight, and more preferably from 3 to 10% by weight.

When the amount of the colorant is too small, the coloring power of the resultant toner deteriorates. When the amount of the colorant is too large, the colorant cannot be sufficiently dispersed in the toner, resulting in deterioration of coloring power and electrical property of the resultant toner.

The colorant for use in the present invention can be combined with a resin to be used as a master batch. Specific examples of the resins for use in the master batch include, but are not limited to, polyesters, styrene polymers and substituted styrene polymers, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

Specific examples of the styrene polymers and substituted styrene polymers include, but are not limited to, polystyrenes, poly-p-chlorostyrenes, polyvinyltoluenes, etc. Specific examples of the styrene copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers, etc.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The colorant can be arbitrarily included in both the first and second binder resin phases due to the difference in affinity between each of the two resins. It is well known that the colorant deteriorates chargeability of the resultant toner when present at the surface thereof. For this reason, it is preferable that the colorant is included in the first binder resin phase so as to improve chargeability (e.g., environmental stability, charge keeping property, charge quantity) of the resultant toner.

(Release Agent)

The toner of the present invention may include a release agent. As the release agent, any known release agents can be used, and are not particularly limited. The release agent preferably has a low melting point of from 50 to 120° C. Since a release agent having a low melting point is easily separated from the binder resin, such a release agent effectively functions at an interface between a fixing roller and the toner. The resultant toner has good hot offset resistance even if used for an oilless fixing system (i.e., no oil is applied to a fixing roller).

As the release agent, waxes are preferably used.

Specific examples of the waxes include, but are not limited to, natural waxes such as plant waxes (e.g., carnauba wax, cotton wax, haze wax, rice wax), animal waxes (e.g., bees wax, lanoline), mineral waxes (e.g., ozokerite, ceresin), and petroleum waxes (e.g., paraffin, microcrystalline, petrolatum); synthetic hydrocarbon waxes such as Fischer-Tropsch wax and polyethylene wax; synthetic waxes such as esters, ketones, and ethers; fatty acid amides such as 12-hydroxystearic acid amide, stearic amide, phthalic anhydride imide, halogenated hydrocarbon; crystalline polymers having a side-chain long alkyl group such as homopolymers or copolymers of polyacrylates such as poly-n-stearyl methacrylate and poly-n-lauryl methacrylate (e.g., copolymer of n-stearyl acrylate and ethyl methacrylate); etc. These can be used alone or in combination.

The release agent preferably has a melting point of from 50 to 120° C., and more preferably from 60 to 90° C.

When the melting point is too small, thermostable preservability of the resultant toner deteriorates. When the melting point is too large, cold offset tends to occur when the resultant toner is fixed at low temperatures.

The release agent preferably has a melt viscosity of 5 to 1000 cps, and more preferably from 10 to 100 cps, when measured at a temperature larger than the melting point thereof by 20° C.

When the melt viscosity is too small, releasability of the resultant toner deteriorates. When the melt viscosity is too large, hot offset resistance and low temperature fixability of the resultant toner deteriorates.

The toner preferably includes the release agent in an amount of from 0 to 40% by weight, and more preferably from 3 to 30% by weight. When the amount is too large, fluidity of the resultant toner deteriorates.

The release agent can be arbitrarily included in both the first and second binder resin phases due to the difference in affinity between each of the two resins. When the release agent is selectively included in the second binder resin phase, the release agent can easily exude from the toner when fixed even if the heating time is short, and therefore the resultant toner has good releasability. On the other hand, when the release agent is selectively included in the first binder resin phase, the release agent is prevented from contaminating other members such as a photoreceptor and a carrier. In the present invention, the release agent can be located in any portion of the toner in response to the demands of the image forming process used.

(Charge Controlling Agent)

Any known charge controlling agents can be used for the toner of the present invention, and are not particularly limited. Specific examples of the charge controlling agents include, but are not limited to, any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. These can be used alone or in combination.

Specific examples of commercially available charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® Nx VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The charge controlling agent can be arbitrarily included in both the first and second binder resin phases due to the difference in affinity between each of the two resins. When the charge controlling agent is selectively included in the second binder resin phase, which forms the outer layer of the toner, the charge control agent can exert its effect even if the amount thereof is small. When the charge controlling agent is selectively included in the first binder resin phase, which forms the inner layer of the toner, the charge controlling agent is prevented from contaminating other members such as a photoreceptor and a carrier. In the present invention, the charge controlling agent can be located in any portion of the toner in response to the demands of the image forming process used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

(Particulate Inorganic Material)

Particulate inorganic materials are used as an external additive so as to impart fluidity, developability, chargeability, etc. to the resultant toner. Any known particulate inorganic materials can be used. Specific examples of the particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

The particulate inorganic material preferably has a primary particle diameter of from 5 nm to 2 μm, and more preferably from 5 nm to 500 nm. The content of the particulate inorganic material is preferably from 0.01 to 5.0% by weight, and more preferably from 0.01 to 2.0% by weight, based on the total weight of the toner.

(Fluidity Improving Agent)

The above particulate inorganic materials are preferably surface-treated to improve the hydrophobicity thereof. Such a surface-treated inorganic material can prevent deterioration of fluidity and chargeability of the toner even under high humidity conditions. Specific examples of surface treatment agents include, but are not limited to, silane coupling agents, silylation agents, silane coupling agents having a fluorinated alkyl group, organic titanate coupling agents, aluminum coupling agents, silicone oils, modified silicone oils, etc. The above-mentioned silica and titanium oxide are preferably surface treated with these surface treatment agents.

(Cleanability Improving Agent)

A cleanability improving agent is added to the toner so as to remove toner particles remaining on the surface of a photoreceptor or a primary transfer medium after a toner image is transferred. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

(Magnetic Material)

Any known magnetic materials can be used for the toner of the present invention, and are not particularly limited. Specific examples of the magnetic materials include, but are not limited to, iron powder, magnetite, ferrite, etc. Whitish materials are preferably used in terms of color tone of the toner.

Method of Preparing Toner

The toner of the present invention is prepared by a method comprising:

dissolving or dispersing toner constituents in an organic solvent to prepare a toner constituent solution or dispersion; and emulsifying or dispersing the toner constituent solution or dispersion in an aqueous medium to prepare an emulsion or a dispersion containing resin particles (i.e., mother toner particles).

Preferably, the toner of the present invention is prepared by a method comprising:

emulsifying or dispersing a toner constituent solution or dispersion comprising a compound having an active hydrogen group and a polymer capable of reacting with the active hydrogen group in an aqueous medium, to prepare resin particles (i.e., mother toner particles) comprising an adhesive base material obtained by subjecting the compound and the polymer to a reaction.

(Toner Constituent Solution or Dispersion)

The toner constituent solution or dispersion is prepared by dissolving or dispersing toner constituents in an organic solvent. Any known toner constituents can be used, and are not particularly limited. For example, the toner constituent solution or dispersion includes at least any one of a compound having an active hydrogen group and a polymer (i.e., prepolymer) capable of reacting with the active hydrogen, and optionally includes an unmodified polyester resin, a release agent, a colorant, a charge controlling agent, etc.

The organic solvent is preferably removed from the toner constituent solution or dispersion while or after toner particles are granulated.

(Organic Solvent)

Any known organic solvents which can dissolve and/or disperse toner constituents can be used, and are not particularly limited. Volatile organic solvents having a boiling point of less than 150° C. are preferably used because such solvents can be easily removed. Specific examples of the organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. Among these, ester solvents are preferably used, and ethyl acetate is most preferably used. These organic solvents can be used alone or in combination.

The toner constituent solution or dispersion typically includes an organic solvent in an amount of from 40 to 300 parts by weight, preferably from 60 to 140 parts by weight, and more preferably from 80 to 120 parts by weight, based on 100 parts by weight of the toner constituents.

The toner constituent solution or dispersion can be prepared by dissolving or dispersing toner constituents such as a compound having an active hydrogen group, a polymer (i.e., prepolymer) capable of reacting with the active hydrogen group, an unmodified polyester resin, a release agent, a colorant, and a charge controlling agent, in an organic solvent. The toner constituents except the prepolymer may be added to an aqueous medium (this will be explained later) when the aqueous medium is prepared, or when the toner constituent solution or dispersion is added thereto.

(Compound Having Active Hydrogen Group)

The compound having an active hydrogen group acts as an elongation agent and/or a crosslinking agent when the polymer capable of reacting with the active hydrogen group is subjected to an elongation reaction and/or a crosslinking reaction in an aqueous medium.

Any known compounds having an active hydrogen group can be used as the compound having an active hydrogen group of the present invention, and are not particularly limited. For example, when a polymer capable of reacting with the active hydrogen group is a polyester prepolymer (A) having an isocyanate group, an amine (B) is preferably used as the compound having an active hydrogen group, because the amine (B) can react with the polyester prepolymer (A) having an isocyanate group so as to prepare a high-molecular-weight polymer by an elongation reaction or a crosslinking reaction.

Specific examples of the active hydrogen groups include, but are not limited to, hydroxyl group (alcoholic hydroxyl group or phenolic hydroxyl group), amino group, carboxyl group, mercapto group, etc. These can be used alone or in combination. Among these, alcoholic hydroxyl group is preferably used.

Any known amines can be used as the amine (B) of the present invention. Specific examples of the amines (B) include, but are not limited to, diamines (B1), polyamines (B2) having three or more amino groups, amino alcohols (B3), amino mercaptans (B4), amino acids (B5), and blocked amines (B6) in which the amino groups in the amines (B1) to (B5) are blocked. These can be used alone or in combination. Among these amines (B), diamines (B1) and mixtures in which a diamine (B1) is mixed with a small amount of polyamine (B2) are preferably used.

Specific examples of the diamines (B1) include, but are not limited to, aromatic diamines such as phenylene diamine, diethyltoluene diamine, and 4,4'-diaminodiphenyl methane; alicyclic diamines such as 4,4'-diamino-3,3'-dimethyldicyclohexyl methane, diaminocyclohexane, and isophoronediamine; aliphatic diamines such as ethylene diamine, tetramethylene diamine, and hexamethylene diamine; etc.

Specific examples of the polyamines (B2) having three or more amino groups include, but are not limited to, diethylene triamine, triethylene tetramine, etc. Specific examples of the amino alcohols (B3) include, but are not limited to, ethanolamine, hydroxyethyl aniline, etc. Specific examples of the amino mercaptan (B4) include, but are not limited to, aminoethyl mercaptan, aminopropyl mercaptan, etc. Specific examples of the amino acids (B5) include, but are not limited to, amino propionic acid, amino caproic acid, etc.

Specific examples of the blocked amines (B6) include, but are not limited to, ketimine compounds which are prepared by reacting one of the amines (B1) to (B5) with a ketone such as acetone, methyl ethyl ketone and methyl isobutyl ketone; oxazoline compounds; etc.

When an elongation reaction and/or a crosslinking reaction between the compound having an active hydrogen group and the polymer capable of reacting with the active hydrogen group is stopped, reaction stopping agents can be used. The reaction stopping agents are preferably used in terms of controlling the molecular weight of the reaction product (i.e., the resultant adhesive base material).

Specific examples of the reaction stopping agents include, but are not limited to, monoamines such as diethyl amine, dibutyl amine, butyl amine, and lauryl amine; and blocked amines, i.e., ketimine compounds prepared by blocking the monoamines mentioned above.

The mixing ratio (i.e., an equivalent ratio [NCO]/[NHx]) of the content of the polyester prepolymer (A) having an isocyanate group to the amine (B) is from 1/3 to 3/1, preferably from 1/2 to 2/1, and more preferably from 1/1.5 to 1.5/1. When the mixing ratio is too small, low-temperature fixability of the resultant toner deteriorates. When the mixing ratio is too large, the resultant urea-modified polyester resin has too low a molecular weight, resulting in deterioration of hot offset resistance of the resultant toner.

(Polymer Capable of Reacting with Active Hydrogen Group)

As the polymer capable of reacting with an active hydrogen group (i.e., prepolymer), any known compounds having a site capable of reacting with an active hydrogen group can be used, and are not particularly limited. Specific examples of such polymers include, but are not limited to, polyol resins, polyacrylic resins, polyester resins, epoxy resins, etc., and derivative resins thereof. These resins can be used alone or in combination. Among these resins, polyester resins are preferably used because of having high fluidity and transparency when melted. These resins can be used alone or in combination.

As the site capable of reacting with an active hydrogen group, which is included in the prepolymer, any known functional groups can be used. Specific examples of the functional groups include, but are not limited to, isocyanate group, epoxy group, carboxylic group, acid chloride group, etc. These functional groups can be included in the prepolymer alone or in combination. Among these, isocyanate group is most preferably included therein.

Among the prepolymers, a polyester resin (RMPE) having a functional group capable of forming a urea bond is preferably used. It is easy to control the molecular weight of the resultant resin when such a polyester resin is used, and therefore the resultant resin can impart good releasability and fixability to the resultant toner even if the fixing device includes no oil applying system, which applies a release oil to the heating medium for fixing.

Specific examples of the functional groups capable of forming a urea bond include isocyanate group, but are not limited thereto. When a RMPE includes an isocyanate group as the functional group capable of forming a urea bond, the polyester prepolymer (A) having an isocyanate group is preferably used as the RMPE.

Specific examples of the polyester prepolymers (A) having an isocyanate group include compounds obtained by reacting (i) a base polyester formed by polycondensation reaction between a polyol (PO) and a polycarboxylic acid (PC), and having an active hydrogen group, with (ii) a polyisocyanate (PIC), but are not limited thereto.

As the polyol (PO), diols (DIO), polyols (TO) having three or more valences, and mixtures thereof can be used. These can be used alone or in combination. Among these, diols (DIO) alone, and mixtures in which a diol (DIO) is mixed with a small amount of a polyol (TO) having three or more valences are preferably used.

Specific examples of the diols (DIO) include, but are not limited to, alkylene glycols, alkylene ether glycols, alicyclic diols, adducts of the alicyclic diols with an alkylene oxide, bisphenols, adducts of the bisphenols with an alkylene oxide, etc.

Specific examples of the alkylene glycols include, but are not limited to, glycols having 2 to 12 carbon atoms such as ethylene glycol, 1,2-propylene glycol, 1,3-propylene glycol, 1,4-butanediol, and 1,6-hexanediol. Specific examples of the alkylene ether glycols include, but are not limited to, diethylene glycol, triethylene glycol, dipropylene glycol, polyethylene glycol, polypropylene glycol, polytetramethylene ether glycol, etc. Specific examples of the alicyclic diols include, but are not limited to, 1,4-cyclohexanedimethanol, hydrogenated bisphenol A, etc. Specific examples of the adducts of the alicyclic diols with an alkylene oxide include, but are not limited to, the adducts of the alicyclic diol with ethylene oxide, propylene oxide, butylenes oxide, etc. Specific examples of the bisphenols include, but are not limited to, bisphenol A, bisphenol F, bisphenol S, etc. Specific examples of the adducts of the bisphenols with an alkylene oxide include, but are not limited to, the adducts of the bisphenol with ethylene oxide, propylene oxide, butylenes oxide, etc.

Among these, alkylene glycols having 2 to 12 carbon atoms and adducts of bisphenols with an alkylene oxide are preferably used, and adducts of bisphenols with an alkylene oxide alone and mixtures thereof are more preferably used.

Specific examples of the polyols (TO) having three or more valences include, but are not limited to, multivalent aliphatic alcohols having three or more valences, polyphenols having three or more valences, adducts of the polyphenols having three or more valences with an alkylene oxide, etc. Specific examples of the multivalent aliphatic alcohols having three or more valences include, but are not limited to, glycerin, trimethylolethane, trimethylolpropane, pentaerythritol, sorbitol, etc. Specific examples of the polyphenols having three or more valences include, but are not limited to, trisphenols (e.g., trisphenol PA manufactured by Honshu Chemical Industry), phenol novolac, cresol novolac, etc. Specific examples of the adducts of the polyphenols having three or more valences with an alkylene oxide include, but are not limited to, the adducts of the polyphenols having three or more valences with ethylene oxide, propylene oxide, butylenes oxide, etc.

The mixing ratio (i.e., DIO/TO) of the content of the diol (DIO) to the polyol (TO) having three or more valences is preferably from 100/0.01 to 100/10, and more preferably from 100/0.01 to 100/1.

As the polycarboxylic acid (PC), dicarboxylic acids (DIC), polycarboxylic acids (TC) having three or more valences, and mixtures thereof can be used. These can be used alone or in combination. Among these, dicarboxylic acids (DIC) alone, and mixtures in which a dicarboxylic acid (DIC) is mixed with a small amount of a polycarboxylic acid (TC) having three or more valences are preferably used.

Specific examples of the dicarboxylic acids (DIC) include, but are not limited to, alkylene dicarboxylic acids, alkenylene dicarboxylic acids, aromatic dicarboxylic acids, etc. Specific examples of the alkylene dicarboxylic acids include, but are not limited to, succinic acid, adipic acid, sebacic acid, etc. Specific examples of the alkenylene dicarboxylic acids include, but are not limited to, alkenylene dicarboxylic acids having 4 to 20 carbon atoms such as maleic acid and fumaric acid. Specific examples of the aromatic dicarboxylic acids include, but are not limited to, aromatic dicarboxylic acids having 8 to 20 carbon atoms such as phthalic acid, isophthalic acid, terephthalic acid, and naphthalene dicarboxylic acid. Among these, alkenylene dicarboxylic acids having 4 to 20 carbon atoms and aromatic dicarboxylic acids having 8 to 20 carbon atoms are preferably used.

Specific examples of the polycarboxylic acid (TC) having three or more valences include, but are not limited to, aromatic polycarboxylic acids, etc. Specific examples of the aromatic polycarboxylic acids include, but are not limited to, aromatic polycarboxylic acids having 9 to 20 carbon atoms such as trimellitic acid and pyromellitic acid.

As the polycarboxylic acid (PC), acid anhydrides and lower alkyl esters of dicarboxylic acids (DIC), polycarboxylic acids (TC) having three or more valences, and mixtures thereof, can also be used. Suitable lower alkyl esters include, but are not limited to, methyl esters, ethyl esters, isopropyl esters, etc.

The mixing ratio (i.e., DIC/TC) of the content of the dicarboxylic acid (DIC) to the polycarboxylic acid (TC) having three or more valences is preferably from 100/0.01 to 100/10, and more preferably from 100/0.01 to 100/1.

A polyol (PO) and a polycarboxylic acid (PC) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester prepolymer (A) having an isocyanate group preferably includes a polyol (PO) unit in an amount of from 0.5 to 40% by weight, more preferably from 1 to 30% by weight, and much more preferably from 2 to 20% by weight, but the content of the polyol (PO) unit is not particularly limited. When the content is too small, hot offset resistance of the resultant toner deteriorates and the toner cannot have a good combination of thermostable preservability and low-temperature fixability. When the content is too large, low-temperature fixability of the resultant toner deteriorates.

Specific examples of the polyisocyanates (PIC) include, but are not limited to, aliphatic polyisocyanates, alicyclic polyisocyanates, aromatic diisocyanates, aromatic aliphatic diisocyanates, isocyanurates, phenol derivatives thereof, the above-mentioned polyisocyanates blocked with oxime, caprolactam, etc.

Specific examples of the aliphatic polyisocyanates include, but are not limited to, tetramethylene diisocyanate, hexamethylene diisocyanate, 2,6-diisocyanatemethyl caproate, octamethylene diisocyanate, decamethylene diisocyanate, dodecamethylene diisocyanate, tetradecamethylene diisocyanate, trimethylhexane diisocyanate, tetramethylhexane diisocyanate, etc. Specific examples of the alicyclic polyisocyanates include, but are not limited to, isophorone diisocyanate, cyclohexylmethane diisocyanate, etc. Specific examples of the aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, diphenylether-4,4'-diisocyanate, etc. Specific examples of the aromatic aliphatic diisocyanates include, but are not limited to, α,α,α',α'-tetramethylxylylene diisocyanate, etc. Specific examples of the isocyanurates include, but are not limited to, tris-isocyanatoalkyl-isocyanurate, triisocyanatocycloalkyl-isocyanurate, etc. These can be used alone or in combination.

A polyisocyanate (PIC) is mixed with a polyester resin having an active hydrogen group (e.g., a polyester resin having a hydroxyl group) so that the equivalent ratio ([NCO]/[OH]) of isocyanate group [NCO] to hydroxyl group [OH] is typically from 5/1 to 1/1, preferably from 4/1 to 1.2/1 and more preferably from 3/1 to 1.5/1. When the ratio [NCO]/[OH] is too large, low temperature fixability of the resultant toner deteriorates. When the ratio [NCO]/[OH] is too small, hot offset resistance of the resultant toner deteriorates.

The polyester prepolymer (A) having an isocyanate group preferably includes a polyisocyanate (PIC) unit in an amount of from 0.5 to 40% by weight, preferably from 1 to 30% by weight, and more preferably from 2 to 20% by weight. When the content is too small, hot offset resistance of the resultant toner deteriorates and the toner cannot have a good combination of thermostable preservability and low-temperature fixability. When the content is too large, low-temperature fixability of the resultant toner deteriorates.

The average number of isocyanate group included in a molecule of the polyester prepolymer (A) is preferably 1 or more, more preferably from 1.2 to 5, and much more preferably from 1.5 to 4. When the number of isocyanate groups is less than 1 per molecule, the molecular weight of the urea-modified polyester decreases and hot offset resistance of the resultant toner deteriorates.

The polymer capable of reacting with an active hydrogen group preferably has a weight average molecular weight (Mw) of from 3,000 to 40,000, and more preferably from 4,000 to 30,000, when the molecular weight distribution of the tetrahydrofuran (THF) soluble components of the above polymer is determined by gel permeation chromatography (GPC). When the Mw is too small, thermostable preservability of the resultant toner deteriorates. When the Mw is too large, low-temperature fixability of the resultant toner deteriorates.

The molecular weight distribution can be measured with a gel permeation chromatography (GPC) system by the following method:

(1) columns are stabilized in a heat chamber at a temperature of 40° C., and THF (i.e., column solvent) flows therein at a flow rate of 1 ml/min; and (2) from 50 to 200 μl of a sample solution of THF having a concentration of from 0.05 to 0.6% by weight is injected to the columns.

A molecular weight is calculated from a calibration curve (i.e., a relationship between molecular weight and count number) prepared using standard monodisperse polystyrenes.

For example, standard monodisperse polystyrenes (manufactured by Pressure Chemical Co. or Tosoh Corporation) having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, can be used. It is preferable that at least 10 standard monodisperse polystyrenes are used for preparing the calibration curve. As a detector, a refractive index detector (RI) can be used.

(Aqueous Medium)

Any known aqueous media can be used in the present invention, and are not particularly limited. Specific examples of the aqueous media include, but are not limited to, water, solvents which can be mixed with water, mixtures thereof, etc. Among these, water is preferably used.

Specific examples of the solvents which can be mixed with water include, but are not limited to, alcohols, dimethylformamide, tetrahydrofuran, cellosolves, lower ketones, etc.

Specific examples of the alcohols include, but are not limited to, methanol, isopropanol, ethylene glycol, etc. Specific examples of the lower ketones include, but are not limited to, acetone, methyl ethyl ketone, etc. These can be used alone or in combination.

The aqueous medium for use in the present invention is prepared by dispersing a particulate resin in an aqueous medium. The aqueous medium preferably includes the particulate resin in an amount of from 0.5 to 10% by weight, but the amount is not particularly limited thereto.

Any known resins capable of forming an aqueous dispersion thereof can be used for the particulate resin of the present invention, and are not particularly limited. Both thermoplastic resins and thermosetting resins can be used. Specific examples of the resins for use in the particulate resin include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used because these resins can easily form an aqueous dispersion of fine particles thereof.

Specific examples of the vinyl resins include, but are not limited to, homopolymers and copolymers of a vinyl monomer such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers.

As the particulate resin, copolymers comprising a monomer having at least 2 unsaturated groups can be used.

Specific examples of the copolymers comprising a monomer having at least 2 unsaturated groups include, but are not limited to, sodium salts of sulfate of an ethylene oxide adduct of methacrylic acid (e.g., ELEMINOL RS-30 from Sanyo Chemical Industries Ltd.), divinylbenzene, 1,6-hexanediol acrylate, etc.

The particulate resin can be polymerized by any known methods, and preferably prepared as an aqueous dispersion thereof. Suitable methods for forming an aqueous dispersion of a particulate resin include the following methods:

(1) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(2) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(3) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(4) A resin formed by polymerization reaction (such as addition polymerization, ring-opening polymerization, condensation polymerization, addition condensation, etc.) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(5) A resin formed by polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(6) A resin formed by polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(7) A resin formed by polymerization reaction (such as addition polymerization, ring-opening polymerization, condensation polymerization, addition condensation, etc.) is dissolved in a solvent, and then the resin solution is dispersed in an aqueous medium in the presence of a suitable dispersing agent, followed by removal of the solvent, so that an aqueous dispersion of a particulate resin is formed.

(8) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

(Emulsification or Dispersion)

The toner constituent solution or dispersion is preferably emulsified or dispersed in an aqueous medium while agitated. Any known dispersing methods can be used, and are not particularly limited. For example, any known dispersing machines can be used. Specific examples of the dispersing machines include, but are not limited to, low shearing force type dispersing machines, high shearing force type dispersing machines, etc.

When the toner constituent solution or dispersion is emulsified or dispersed in an aqueous medium, the compound having an active hydrogen group and the polymer capable of reacting with the active hydrogen group are subjected to an elongation or cross-linking reaction and produce an adhesive base material.

(Adhesive Base Material)

The adhesive base material has adhesiveness to a recording medium such as a paper. The adhesive base material includes at least an adhesive polymer formed by reacting the compound having an active hydrogen group and the polymer capable of reacting with the active hydrogen group in an aqueous medium, and may include any known resins.

The adhesive base material preferably has a weight average molecular weight of not less than 3,000, more preferably from 5,000 to 1,000,000, and much more preferably from 7,000 to 500,000. When the weight average molecular weight is too small, hot offset resistance of the resultant toner deteriorates.

The adhesive base material preferably has a glass transition temperature (Tg) of from 30 to 70° C., and more preferably from 40 to 65° C. When the Tg is too small, thermostable preservability of the resultant toner deteriorates. When the Tg is too large, low-temperature fixability of the resultant toner is poor. The toner of the present invention has good preservability even if the Tg is low, compared with conventional polyester toners, because of including a polyester resin prepared by an elongation or cross-linking reaction.

The glass transition temperature can be determined using a TG-DSC system such as TAS-100 (manufactured by Rigaku Corporation) as follows:

(1) about 10 mg of a sample is fed in a sample container made of aluminum, and then the sample container is put on a holder unit and set in an electric furnace;

(2) the sample is heated from room temperature to 150° C. at a temperature rising speed of 10° C./min, and left for 10 minutes at 150° C.;

(3) the sample is cooled to room temperature, and left for 10 minutes at room temperature;

(4) the sample is heated to 150° C. again at a temperature rising speed of 10° C./min to obtain a DSC curve using a differential scanning calorimeter (DSC); and (5) the DSC curve is analyzed with an analysis system of a TG-DSC system TAS-100 to determine a glass transition temperature (Tg), which is determined by finding a contact point between a tangent line of the DSC curve near the glass transition temperature (Tg) and a baseline.

As the adhesive base materials, polyester resins are preferably used, but are not limited thereto.

As the polyester resins, urea-modified polyester resins are preferably used, but are not limited thereto.

The urea-modified polyester resin can be prepared by reacting (i) an amine (B) serving as a compound having an active hydrogen group with (ii) a polyester prepolymer (A) having an isocyanate group, serving as a polymer capable of reacting with the active hydrogen group, in an aqueous medium.

The urea-modified polyester resin may include a urethane bond other than the urea bond. In this case, the molar ratio of the urea bond to the urethane bond (i.e., urea bond/urethane bond) is preferably from 100/0 to 10/90, more preferably from 80/20 to 20/80, and much more preferably from 60/40 to 30/70. When the ratio is too small, hot offset resistance of the resultant toner deteriorates.

Specific preferred examples of suitable urea-modified polyester resins include, but are not limited to, the following (1) to (10):

(1) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and isophthalic acid;

(2) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and terephthalic acid;

(3) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a mixture of an ethylene oxide (2 mol) adduct of bisphenol A and a propylene oxide (2 mol) adduct of bisphenol A, and terephthalic acid;

(4) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a propylene oxide (2 mol) adduct of bisphenol A and terephthalic acid;

(5) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between an ethylene oxide (2 mol) adduct of bisphenol A and terephthalic acid;

(6) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between a mixture of an ethylene oxide (2 mol) adduct of bisphenol A and a propylene oxide (2 mol) adduct of bisphenol A, and terephthalic acid;

(7) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using ethylene diamine, and (ii) a polycondensation product between an ethylene oxide (2 mol) adduct of bisphenol A and terephthalic acid;

(8) a mixture of (i) a urea-modified compound of a polyester prepolymer, which is obtained by reacting diphenylmethane diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid;

(9) a mixture of (i) a urea-modified compound of a polyester prepolymer, which is obtained by reacting diphenylmethane diisocyanate with a polycondensation product between a mixture of an ethylene oxide (2 mol) adduct of bisphenol A and a propylene oxide (2 mol) adduct of bisphenol A, and a mixture of terephthalic acid and dodecenyl succinic anhydride, obtained by using hexamethylene diamine, and (ii) a polycondensation product between a mixture of an ethylene oxide (2 mol) adduct of bisphenol A and a propylene oxide (2 mol) adduct of bisphenol A, and isophthalic acid; and

(10) a mixture of (i) a urea-modified compound of a polyester prepolymer, which is obtained by reacting toluene diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid.

The following methods are suitable for preparing the adhesive base material.

(1) A toner constituent solution or dispersion containing a polymer capable of reacting with an active hydrogen group (e.g., the polyester prepolymer (A) having an isocyanate group) is emulsified or dispersed in an aqueous medium together with a compound having an active hydrogen group (e.g., the amine (B)), to prepare a dispersion of the toner constituent solution or dispersion while subjecting the compound having an active hydrogen group and the polymer capable of reacting with the active hydrogen group to an elongation and/or crosslinking reaction.

(2) The toner constituent solution or dispersion is emulsified or dispersed in an aqueous medium previously containing a compound having an active hydrogen group, to prepare a dispersion of the toner constituent solution or dispersion while subjecting the compound having an active hydrogen group and the polymer capable of reacting with the active hydrogen group to an elongation and/or crosslinking reaction.

(3) The toner constituent solution or dispersion is emulsified or dispersed in an aqueous medium, and then the compound having an active hydrogen group is added thereto, to prepare a dispersion of the toner constituent solution or dispersion while subjecting the compound having an active hydrogen group and the polymer capable of reacting with the active hydrogen group to an elongation and/or crosslinking reaction.

In the above method (3), a modified polyester resin is selectively formed on the surface of the produced toner particles, i.e., the resultant toner can have a concentration gradient thereof.

The reaction conditions for preparing the adhesive base material are not particularly limited, and depend on a combination of a compound having an active hydrogen group and a polymer capable of reacting with the active hydrogen group. However, the reaction time is preferably from 10 minutes to 40 hours, and more preferably from 2 to 24 hours.

In order to stably form an aqueous dispersion containing the polymer capable of reacting with an active hydrogen group (e.g., the polyester prepolymer (A) having an isocyanate group), it is preferable that a toner constituent solution or dispersion, which is prepared by dissolving or dispersing the polymer capable of reacting with an active hydrogen group (e.g., the polyester prepolymer (A) having an isocyanate group), a colorant, a charge controlling agent, a unmodified polyester resin, etc., in an organic solvent, is dispersed in an aqueous medium upon application of shear force.

It is preferable that the content of the aqueous medium used for the emulsification or dispersion is 50 to 2,000 parts by weight, and more preferably 100 to 1,000 parts by weight, based on 100 parts by weight of the toner constituents. When the content is too small, the toner constituent solution or dispersion cannot be well dispersed, and therefore the toner cannot have a desired particle diameter. When the content is too large, the toner manufacturing cost increases.

When the toner constituent solution or dispersion is emulsified or dispersed in an aqueous medium, a dispersant is preferably used to improve stability of the dispersion so as to obtain a toner having a desired shape and a narrow particle diameter distribution.

Any known dispersants can be used in the present invention, and are not particularly limited. Specific examples of the dispersants include, but are not limited to, surfactants, water-insoluble inorganic dispersants, polymeric protection colloids, etc. These can be used alone or in combination. Among these, surfactants are preferably used.

Specific examples of the surfactants include, but are not limited to, anionic surfactants, cationic surfactants, nonionic surfactants, ampholytic surfactants, etc.

Specific examples of the anionic surfactants include, but are not limited to, alkylbenzene sulfonic acid salts, α-olefin sulfonic acid salts, phosphoric acid salts, etc. In particular, anionic surfactants having a fluoroalkyl group are preferably used.

Specific examples of the anionic surfactants having a fluoroalkyl group include, but are not limited to, fluoroalkyl carboxylic acids having 2 to 10 carbon atoms and metal salts thereof, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl (C6-C8)-N-ethylamino}-1-propanesulfonate, fluoroalkyl(C11-C20) carboxylic acids and metal salts thereof, perfluoroalkyl(C7-C13) carboxylic acids and metal salts thereof, perfluoroalkyl(C4-C12) sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonyl glycin, monoperfluoroalkyl(C6-C16) ethylphosphates, etc.

Specific examples of useable commercially available surfactants include, but are not limited to, SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants include, but are not limited to, amine salts, quaternary ammonium salts, etc.

Specific examples of the amine salts include, but are not limited to, alkyl amine salts, aminoalcohol fatty acid derivatives, polyamine fatty acid derivatives, imidazoline, etc. Specific examples of the quaternary ammonium salts include, but are not limited to, alkyltrimethyl ammonium salts, dialkyldimethyl ammonium salts, alkyldimethyl benzyl ammonium salts, pyridinium salts, alkyl isoquinolinium salts, benzethonium chloride, etc.

In particular, primary, secondary and tertiary aliphatic amines having a fluoroalkyl group, aliphatic quaternary salts such as perfluoroalkyl(C6-C10)sulfoneamidepropyltrimethylammorium salts, benzalkonium salts, benzetonium chloride, pyridinium salts, imidazolinium salts, etc., are preferably used.

Specific examples of useable commercially available products thereof include, but are not limited to, SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Specific examples of the nonionic surfactants include, but are not limited to, fatty acid amine derivatives, polyhydric alcohol derivatives, etc.

Specific examples of the ampholytic surfactants include, but are not limited to, aniline, dodecyldi(aminoethyl)glycin, di(octylaminoethyl)glycin, N-alkyl-N,N-dimethylammonium betaine, etc.

Specific examples of the water-insoluble inorganic dispersants include, but are not limited to, tricalcium phosphate, calcium carbonate, titanium oxide, colloidal silica, hydroxyapatite, etc.

Specific examples of the protection colloids include, but are not limited to, homopolymers and copolymers prepared using monomers such as acids, (meth)acrylic monomers having a hydroxyl group, vinyl alcohols and ethers thereof, esters of a vinyl alcohol with a compound having a carboxyl group, amide compounds and methylol compounds thereof, chlorides, and monomers having a nitrogen atom or an alicyclic ring having a nitrogen atom; polyoxyethylene compounds; cellulose compounds; etc.

Specific examples of the acids include, but are not limited to, acrylic acid, methacrylic acid, α-cyanoacrylic acid, α-cyanomethacrylic acid, itaconic acid, crotonic acid, fumaric acid, maleic acid, maleic anhydride, etc.

Specific examples of the (meth)acrylic monomers having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methylolmethacrylamide, etc.

Specific examples of the vinyl alcohols and ethers thereof include, but are not limited to, vinyl methyl ether, vinyl ethyl ether, vinyl propyl ether, etc. Specific examples of the esters of a vinyl alcohol with a compound having a carboxyl group include, but are not limited to, vinyl acetate, vinyl propionate, vinyl butyrate, etc. Specific examples of the amide compounds and methylol compounds thereof include, but are not limited to, acrylamide, methacrylamide, diacetoneacrylamide acid, etc., and methylol compounds thereof.

Specific examples of the chlorides include, but are not limited to, acrylic acid chloride, methacrylic acid chloride, etc.

Specific examples of the monomers having a nitrogen atom or an alicyclic ring having a nitrogen atom include, but are not limited to, vinyl pyridine, vinyl pyrrolidone, vinyl imidazole, ethylene imine, etc.

Specific examples of the polyoxyethylene compounds include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters, etc. Specific examples of the cellulose compounds include, but are not limited to, methyl cellulose, hydroxyethyl cellulose, hydroxypropyl cellulose, etc.

When the dispersion is prepared, a dispersion stabilizer can be optionally used. Specific examples of the dispersion stabilizers include, but are not limited to, calcium phosphate, which is soluble both in acids and bases, etc. When the compound soluble both in acids and bases are used as a dispersion stabilizer, the dispersion stabilizer can be removed by being dissolved by acids such as hydrochloric acid, followed by washing with water, or being decomposed by an enzyme.

When the dispersion is prepared, a catalyst of the elongation and/or crosslinking reaction can be optionally used. Specific examples of the catalysts include, but are not limited to, dibutyltin laurate, dioctyltin laurate, etc.

(Solvent Removal)

The organic solvent is removed from the dispersion (i.e., emulsion slurry). In order to remove an organic solvent from the emulsion, the following methods can be used.

(1) The emulsion is gradually heated to completely evaporate the organic solvent present in the drops of the oil phase.

(2) The emulsion is sprayed in a dry environment to dry the organic solvent in the drops of the oil phase and water in the dispersion, resulting in formation of toner particles.

After the organic solvent is removed, toner particles are obtained. The toner particles are subjected to washing and drying treatment, and then optionally subjected to classification. The toner particles can be classified by removing fine particles by methods such as cyclone, decantation, centrifugal separation, etc., in a liquid. Of course, the dried toner particles can be classified by the above methods.

The dried toner particles can be mixed with other particulate materials such as colorant, release agent, charge controlling agent, etc., optionally upon application of a mechanical impact thereto to fix and fuse the particulate materials on the surface of the toner particles.

Specific examples of such mechanical impact application methods include, but are not limited to, methods in which a mixture is mixed with a highly rotated blade and methods in which a mixture is put into air to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

Toner Properties (Particle Diameter)

The toner of the present invention preferably has a volume average particle diameter of from 3 to 8 μm. When the Dv is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to be caused. In contrast, when the Dv is too large, it is difficult to obtain high definition and high quality images. In addition, an average particle diameter of toner particles included in a developer tends to be largely changed when a part of the toner particles are replaced with fresh toner particles.

The toner preferably has a ratio (Dv/Dn) between the volume average particle diameter (Dv) and a number average particle diameter (Dn) of not greater than 1.30, and more preferably from 1.00 to 1.30. When the ratio (Dv/Dn) is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to be caused. In contrast, when the ratio (Dv/Dn) is too large, it is difficult to obtain high definition and high quality images. In addition, an average particle diameter of toner particles included in a developer tends to be largely changed when a part of the toner particles are replaced with fresh toner particles.

When the ratio (Dv/Dn) is from 1.00 to 1.30, the toner has a good combination of thermostable preservability, low temperature fixability, and hot offset resistance. In particular, the produced full-color images have good glossiness. When such a toner is used for a two-component developer, an average particle diameter of toner particles included in the developer hardly changes even if a part of the toner particles are replaced with fresh toner particles, and therefore the toner has good and stable developability even after a long repeated agitation in the developing unit. When such a toner is used for a one-component developer, an average particle diameter of the toner particles hardly changes even if a part of the toner particles are replaced with fresh toner particles, and the toner hardly forms a film on a developing roller and hardly fuses on a toner layer forming member. Therefore, the toner has good and stable developability even after long repeated use, resulting in producing high quality images.

The volume average particle diameter (Dv), the number average particle diameter (Dn), and the ratio (Dv/Dn) can be determined with an instrument such as COULTER MULTISIZER II (manufactured by Coulter Electrons Inc.).

(Penetration)

The toner of the present invention preferably has a penetration of not less than 15 mm, and more preferably from 20 to 30 mm, which is measured by a method based on JIS K2235-1991. When the penetration is too small, thermostable preservability of the resultant toner deteriorates.

The penetration is measured by the following method based on JIS K2235-1991. At first, a 50 ml glass container is filled with a toner and put in a thermostatic chamber for 20 hours at 50° C., and then the toner is cooled to room temperature and subjected to the penetration test. The larger penetration a toner has, the better thermostable preservability the toner has.

(Fixability)

Fixability is evaluated by the minimum fixable temperature and the maximum fixable temperature above which the offset problem occurs. It is preferable that the minimum fixable temperature is as low as possible, and the maximum fixable temperature is as high as possible. In particular, it is preferable that the minimum fixable temperature is less than 150° C., and the maximum fixable temperature is not less than 200° C.

Fixability is determined by forming images with an image forming apparatus in which a fixing member temperature is variable. The minimum fixable temperature is defined as, for example, the fixing member temperature below which the residual rate of the fixed image density was less than 70% when the fixed image was rubbed with a pad.

The maximum fixable temperature is defined as, for example, the fixing member temperature above which the offset problem occurs in solid images.

(Toner Color)

The color of the toner of the present invention is not limited. However, it is preferable that the toner has at least a color selected from black, cyan, magenta, and yellow. A toner having a desired color can be prepared by choosing a proper colorant from the colorants mentioned above.

Developer

The developer of the present invention includes at least the toner of the present invention and other components such as a carrier as appropriate. The developer may be either a one-component developer or a two-component developer. Two-component developers are preferably used for high-speed printers, which can respond to the demands of improvement of information processing speed, in terms of life thereof.

A one-component developer consisting essentially of the toner of the present invention has a stable average particle diameter even if a part of the toner particles are replaced with fresh toner particles, and hardly forms a film on a developing roller and hardly fuses on a toner layer forming member. Such a one-component developer has stable good developability, and therefore high quality images can be produced even after a long repeated use.

A two-component developer including the toner of the present invention also has a stable average particle diameter even if a part of the toner particles are replaced with fresh toner particles. Such a two-component developer has stable good developability, and therefore high quality images can be produced even after a long repeated use.

Any known carriers can be used for the two-component developer of the present invention, and are not particularly limited. However, carriers including a core and a resin layer which covers the core are preferably used.

Any known cores can be used for the carriers, and are not particularly limited. Specific examples of the cores include, but are not limited to, manganese-strontium (Mn—Sr) materials and manganese-magnesium (Mn—Mg) materials having a magnetization of from 50 to 90 emu/g, etc. In order to obtain images having a high image density, high-magnetization materials such as iron powders (having a magnetization of not less than 100 emu/g) and magnetites (having a magnetization of from 75 to 120 emu/g) are preferably used. In order to obtain high quality images, low-magnetization materials such as copper-zinc (Cu—Zn) materials (having a magnetization of from 30 to 80 emu/g) are preferably used, because the magnet brushes can weakly contact a photoreceptor in such a case. These materials can be used alone or in combination.

The core preferably has a volume average particle diameter of from 10 to 150 μm, and more preferably from 40 to 100 μm. When the volume average particle diameter is too small, the carrier includes too large an amount of fine particles and therefore magnetization per carrier particle decreases, resulting in occurrence of carrier scattering. When the volume average particle is too large, the carrier has too small a specific surface area and therefore carrier scattering tends to occur and image reproducibility deteriorates especially in full-color solid images.

Any known resins can be used for the resin layer, and are not particularly limited. Specific examples of the resins include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers (e.g., terpolymer of tetrafluoroethylene and vinylidene fluoride and non-fluoride monomer), silicone resins, etc. These resins can be used alone or in combination.

Specific examples of the amino resins include, but are not limited to, urea-formaldehyde resins, melamine resins, benzoguanamine resins, urea resins, polyamide resins, epoxy resins, etc. Specific examples of the polyvinyl resins include, but are not limited to, acrylic resins, polymethyl methacrylate resins, polyacrylonitrile resins, polyvinyl acetate resins, polyvinyl alcohol resins, polyvinyl butyral resins, etc. Specific examples of the polystyrene resins include, but are not limited to, polystyrene resins, styrene-acrylic copolymer resins, etc. Specific examples of the halogenated olefin resins include, but are not limited to, polyvinyl chloride, etc. Specific examples of the polyester resins include, but are not limited to, polyethylene terephthalate resins, polybutylene terephthalate resins, etc.

The resin layer optionally includes particulate conductive materials. Specific examples of the particulate conductive materials include, but are not limited to, metal powders, carbon blacks, titanium oxides, tin oxides, zinc oxides, etc. The particulate conductive material preferably has an average particle diameter of not greater than 1 μm. When the average particle diameter is too small, it is difficult to control the electrical resistance of the carrier.

The resin layer can be formed by, for example, dissolving a silicone resin, etc. in an organic solvent to prepare a resin layer constituent liquid, and then the resin layer constituent liquid is uniformly coated on the core by known methods such as dip coating, spray coating, brush coating, etc. The coated core is then subjected to drying and baking.

Specific examples of the organic solvents include toluene, xylene, methyl ethyl ketone, methyl isobutyl ketone, cellosolve butyl acetate, etc., but are not limited thereto.

The baking method can be either or both of an external heating method or an internal heating method. Specific baking methods include methods using a fixed electric furnace, a portable electric furnace, a rotary electric furnace, a burner furnace and a microwave, but are not limited thereto.

The carrier preferably includes the resin layer in an amount of from 0.01 to 5.0% by weight. When the amount is too small, the resin layer cannot be uniformly formed on the surface of the core. When the amount is too large, the carrier has too thick a resin layer and therefore each of the carrier particles tend to aggregate. In this case, uneven carrier particles are obtained.

The two-component developer preferably includes the carrier in an amount of from 90 to 98% by weight, and more preferably from 93 to 97% by weight.

The developer including the toner of the present invention has a good combination of toner properties such as aggregation resistance, chargeability, fluidity, transferability, fixability, and thermostable preservability, and produces high quality images having good color reproducibility, image density, transparency, and definition, which are comparable to those produced by silver salt methods and printings.

The developer of the present invention is preferably used for any known electrophotographic image forming methods such as magnetic one-component developing methods, non-magnetic one-component developing methods, and two-component developing methods.

Toner Container

The toner (developer) of the present invention can be contained in ant known container, and are not particularly limited. Suitable toner containers include any known containers including a main body of a toner container and a cap.

The toner container is not limited in size, shape, structure, material, etc. The toner container preferably has a cylinder shape having spiral projections and depressions on the inner surface thereof. Such a toner container can feed a toner to an ejection opening by rotating. It is more preferable that a part of the spiral parts, or all of the spiral parts of such a toner container have a structure like an accordion.

Suitable materials for use in the toner container include materials having good dimensional accuracy. In particular, resins are preferably used. Specific examples of the resins for use in the toner container include, but are not limited to, polyester resins, polyethylene resins, polypropylene resins, polystyrene resins, polyvinylchloride resins, polyacrylic acids, polycarbonate resins, ABS resins, polyacetal resins, etc.

The toner container can be easily preserved, transported, handled, and detached from the process cartridge and the image forming apparatus of the present invention (to be hereinafter explained) to feed a developer thereto.

Process Cartridge

The process cartridge of the present invention comprises:

an image bearing member configured to bear an electrostatic latent image; and a developing device configured to develop the electrostatic latent image with a developer including a toner to form a toner image on the image bearing member, and optionally includes other devices.

The developing device comprises:

a developer container configured to contain the toner or developer of the present invention; and a developer bearing member configured to bear and transport the toner or developer contained in the developer container, and optionally includes a thickness controlling member configured to control the thickness of the toner or developer layer formed on the image bearing member.

The process cartridge of the present invention is detachably attachable to any image forming apparatuses using the electrophotography, and preferably detachably attachable to the image forming apparatus of the present invention (to be hereinafter explained).

Image Forming Apparatus and Image Forming Method

The image forming method of the present invention comprises:

forming an electrostatic latent image on an image bearing member (i.e., electrostatic latent image forming process);

developing the electrostatic latent image with a developer including a toner to form a toner image on the image bearing member (i.e., developing process);

transferring the toner image onto a transfer material (i.e., transfer process); and fixing the toner image on a recording medium (i.e., fixing process), and optionally includes a discharging process, a cleaning process, a recycling process, a controlling process, etc.

The image forming apparatus of the present invention comprises:

an electrostatic latent image bearing member;

an electrostatic latent image forming device configured to form an electrostatic latent image on the electrostatic latent image bearing member;

a developing device configured to develop the electrostatic latent image with a toner to form a toner image;

a transfer device configured to transfer the toner image onto a recording medium; and a fixing device configured to fix the transferred image onto the recording medium;

and preferably includes a cleaning device and optionally includes other devices, such as a discharging device, a recycling device, a controlling device, etc., if desired.

The image forming method of the present invention is preferably performed using the image forming apparatus of the present invention. Namely, the electrostatic latent image forming process can be performed with the electrostatic latent image forming device, the developing process can be performed with the developing device, the transfer process can be performed with the transfer device, the fixing process can be performed with the fixing device, and the other processes can be performed with the corresponding devices.

Each of the image forming processes and image forming devices will be explained in detail below.

(Electrostatic Latent Image Forming Process and Device)

In the electrostatic latent image forming process, an electrostatic latent image is formed on an image bearing member.

The image bearing member (i.e., photoreceptor) is not limited in material, shape, structure, size, etc., and any known image bearing members can be used. However, the image bearing member preferably has a cylinder shape. Specific examples of the materials used for the image bearing members include amorphous silicon and selenium (used for inorganic photoreceptors), polysilane and phthalopolymethine (used for organic photoreceptors), etc. Among these, amorphous silicon is preferably used with respect to the long life of the photoreceptor.

The electrostatic latent image is formed by irradiating the charged image bearing member with a light containing image information in an electrostatic latent image forming device.

The electrostatic latent image forming device comprises a charger configured to charge the image bearing member, and a light irradiator configured to irradiate the charged image bearing member with a light containing image information on the image bearing member.

The image bearing member is charged by applying a voltage to the surface thereof by the charger. Specific examples of the chargers include known contact chargers including a member such as an electroconductive or semiconductive roller, a brush, a film, a rubber blade, etc., and non-contact chargers using corona discharge such as corotron and scorotron, etc.

The light irradiator irradiates the surface of the charged image bearing member with a light containing image information. Specific examples of the light irradiators include an emit optical irradiator, a rod lens array irradiator, a laser optical irradiator, a liquid crystal shutter irradiator, etc.

In the present invention, the image bearing member can be irradiated from the back side thereof.

(Developing Process and Device)

In the developing process, the electrostatic latent image is developed with the toner or the developer of the present invention to form a toner image on the image bearing member. The toner image is formed with a developing device.

Suitable developing devices include any known developing devices which can use the toner or the developer of the present invention, and are not particularly limited. For example, a developing device containing the toner or the developer of the present invention, and capable of directly or indirectly adhering the toner or the developer to the electrostatic latent image is preferably used. Such a developing device further including the above-mentioned toner container is more preferably used.

The developing device may be either or both of a dry developing device or a wet developing device in the present invention. Moreover, the developing device may be either or both of a single-color developing device or a multi-colored developing device in the present invention. The developing device preferably includes an agitator configured to agitate the developer so as to be charged, and a rotatable magnetic roller.

In the developing device, the toner and the carrier are mixed and agitated. The toner is charged by the agitation, and held in a magnetic brush which is formed on the surface of a rotating magnetic roller. Because the magnetic roller is arranged near the image bearing member (photoreceptor), a part of the toner held in the magnetic brush, which is formed on the surface of the rotating magnetic roller, is moved to the surface of the image bearing member (photoreceptor) due to the electric force. Namely, the electrostatic latent image is developed with the toner to form a toner image on the image bearing member.

The developer contained in the developing device may be both a one-component developer and a two-component developer.

(Transfer Process and Device)

In the transfer process, the toner image is transferred onto a recording medium. It is preferable that the toner image is firstly transferred onto an intermediate transfer medium, and then secondly transferred onto the recording medium. It is more preferable that the toner image is a multiple toner image which is formed with two or more full-color toners, and the multiple toner image is firstly transferred onto the intermediate transfer medium (i.e., primary transfer process), and then secondly transferred onto the recording medium (i.e., secondary transfer process).

The toner image is charged with a transfer charger and then transferred with a transfer device.

The transfer device preferably includes a primary transfer device configured to transfer a toner image onto an intermediate transfer medium to form a multiple toner image, and a secondary transfer device configured to transfer the multiple toner image onto a recording medium.

As the intermediate transfer medium, any known transfer media can be used. In particular, an endless transfer belt is preferably used.

The transfer device (the primary transfer device and the secondary transfer device) preferably comprises a transfer device configured to attract the toner image from the image bearing member (photoreceptor) to the recording medium. The number of transfer devices can be one or more.

Specific examples of the transfer devices include a corona transfer device, a transfer belt, a transfer roller, a pressure transfer roller, an adhesion transfer member, etc.

Any known recording media (e.g., recoding papers) can be used as the recording media, and are not particularly limited.

(Fixing Process and Device)

In the fixing process, the toner image transferred onto the recording medium is fixed with a fixing device. The toner image can be fixed every time after each of toner image is transferred onto the recording medium one by one. Of course, the toner image can be fixed after all of the toner images are transferred and superimposed on the recording medium.

As the fixing device, heat pressing devices are preferably used, but are not limited thereto. The heat pressing device typically includes a combination of a heat roller and a pressing roller; and a combination of a heat roller, a pressing roller, and an endless belt; etc.

Heating temperature of the heat pressing device is preferably from 80 to 200° C.

In the present invention, any known light fixing devices can be used in combination with the heat fixing device, or instead of the heat fixing device.

(Discharging Process and Device)

In the discharging process, a discharging bias is applied to the electrostatic latent image bearing member so as to remove the charge therefrom with the discharging device. As the discharging device, any known discharging devices which can apply a discharging bias to the electrostatic latent image bearing member can be used, and is not particularly limited. For example, a discharging lamp is preferably used.

(Cleaning Process and Device)

In the cleaning process, residual toner particles remaining on the electrostatic latent image bearing member are removed with a cleaning device.

As the cleaning device, any known cleaning devices which can remove residual toner particles from the electrostatic latent image bearing member can be used, and is not particularly limited. Specific examples of usable cleaning devices include, but are not limited to, a magnetic brush cleaner, an electrostatic brush cleaner, a magnetic roller cleaner, a blade cleaner, a web cleaner, etc.

(Recycle Process and Device)

In the recycling process, the toner particles removed with the cleaning device are collected and transported to the developing device with a recycling device.

As the recycling device, any known transport device can be used, and is not particularly limited.

(Controlling Process and Device)

In the controlling process, each image forming process is controlled with a controlling device.

Specific examples of the controlling device include sequencers, computers, etc., but are not limited thereto.

Image Forming Apparatus

Figure 4:
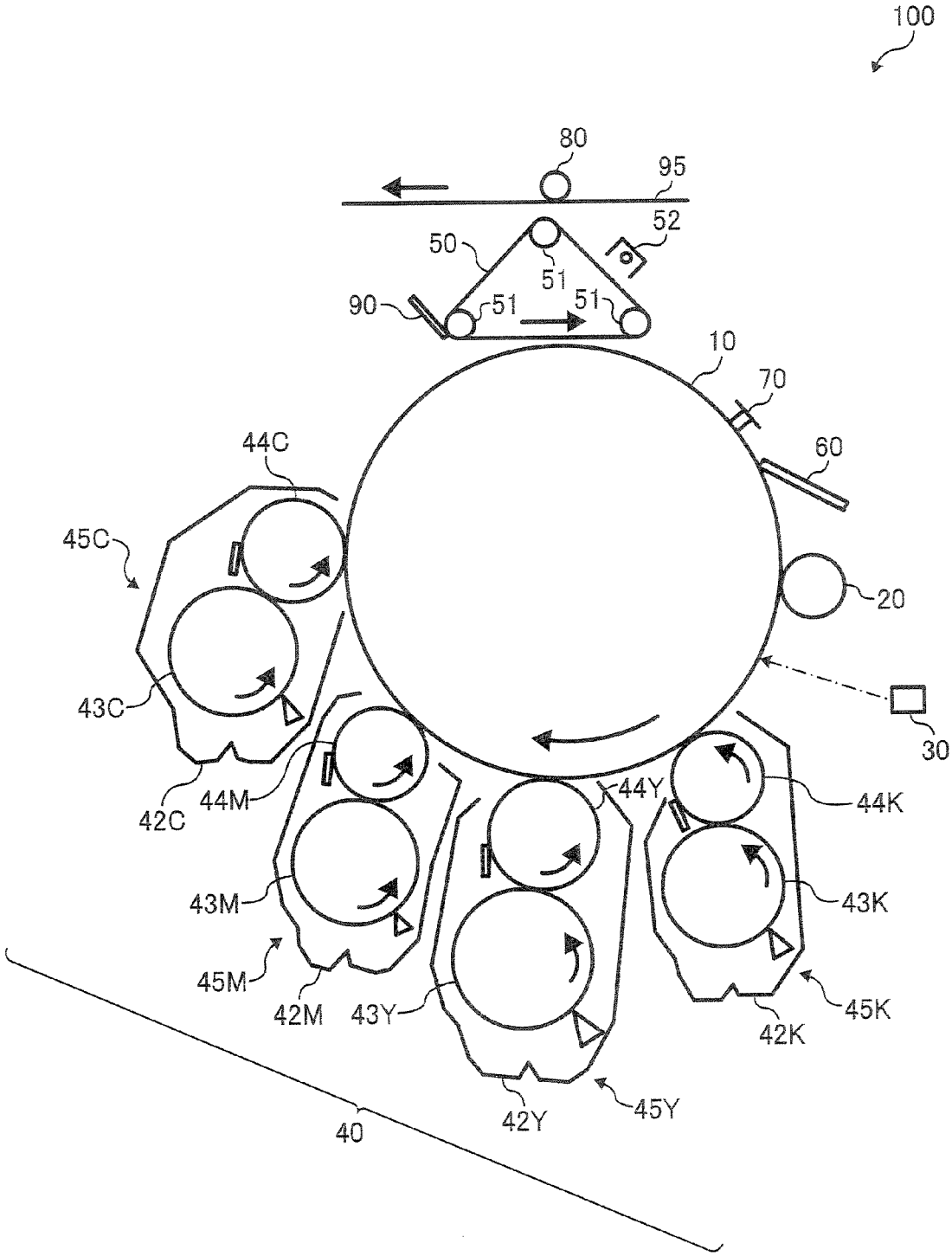
FIG. 4 is a schematic view partially illustrating an embodiment of the image forming apparatus of the present invention.

FIG. 4 is a schematic view illustrating an embodiment of the present invention.

An image forming apparatus 100 includes a photoreceptor 10 serving as the image bearing member, a charging roller 20 serving as the charging device, a light irradiator 30 serving as the irradiating device, a developing device 40 serving as the developing device, an intermediate transfer medium 50, a cleaning device 60 including a cleaning blade serving as the cleaning device, and a discharging lamp 70 serving as the discharging device.

The intermediate transfer medium 50 is an endless belt. The intermediate transfer medium 50 is tightly stretched with three rollers 51 to move endlessly in the direction indicated by an arrow. Some of the rollers 51 have a function of applying a transfer bias (primary transfer bias) to the intermediate transfer medium 50.

A cleaning device 90 including a cleaning blade is arranged close to the intermediate transfer medium 50. A transfer roller 80 is arranged facing the intermediate transfer medium 50. The transfer roller 80 can apply a transfer bias to a transfer paper 95, serving as a final transfer material, to transfer (i.e., secondary transfer) a toner image.

A corona charger 52 configured to charge the toner image on the intermediate transfer medium 50 is arranged on a downstream side from a contact point of the photoreceptor 10 and the intermediate transfer medium 50, and a upstream side from a contact point of the intermediate transfer medium 50 and the transfer paper 95, relative to the rotating direction of the intermediate transfer medium 50.

The developing device 40 includes a black developing unit 45K, a yellow developing unit 45Y, a magenta developing unit 45M and a cyan developing unit 45C, arranged around the photoreceptor 10. The developing units 45K, 45Y, 45M and 45C include developer containers 42K, 42Y, 42M and 42C, developer feeding rollers 43K, 43Y, 43M and 43C, and developing rollers 44K, 44Y, 44M and 44C, respectively.

In the image forming apparatus 100, the photoreceptor 10 is uniformly charged by the charging roller 20, and then the light irradiator 30 irradiates the photoreceptor 10 with a light containing image information to form an electrostatic latent image thereon. The electrostatic latent image formed on the photoreceptor 10 is developed with a toner supplied from the developing device 40, to form a toner image.

The toner image is transferred onto the intermediate transfer medium 50 due to a bias applied to a roller 51 (i.e., primary transfer), and then transferred onto the transfer paper 95 (i.e., secondary transfer). Toner particles remaining on the photoreceptor 10 are removed using the cleaning device 60, and the photoreceptor 10 is once discharged by the discharging lamp 70.

Figure 5:
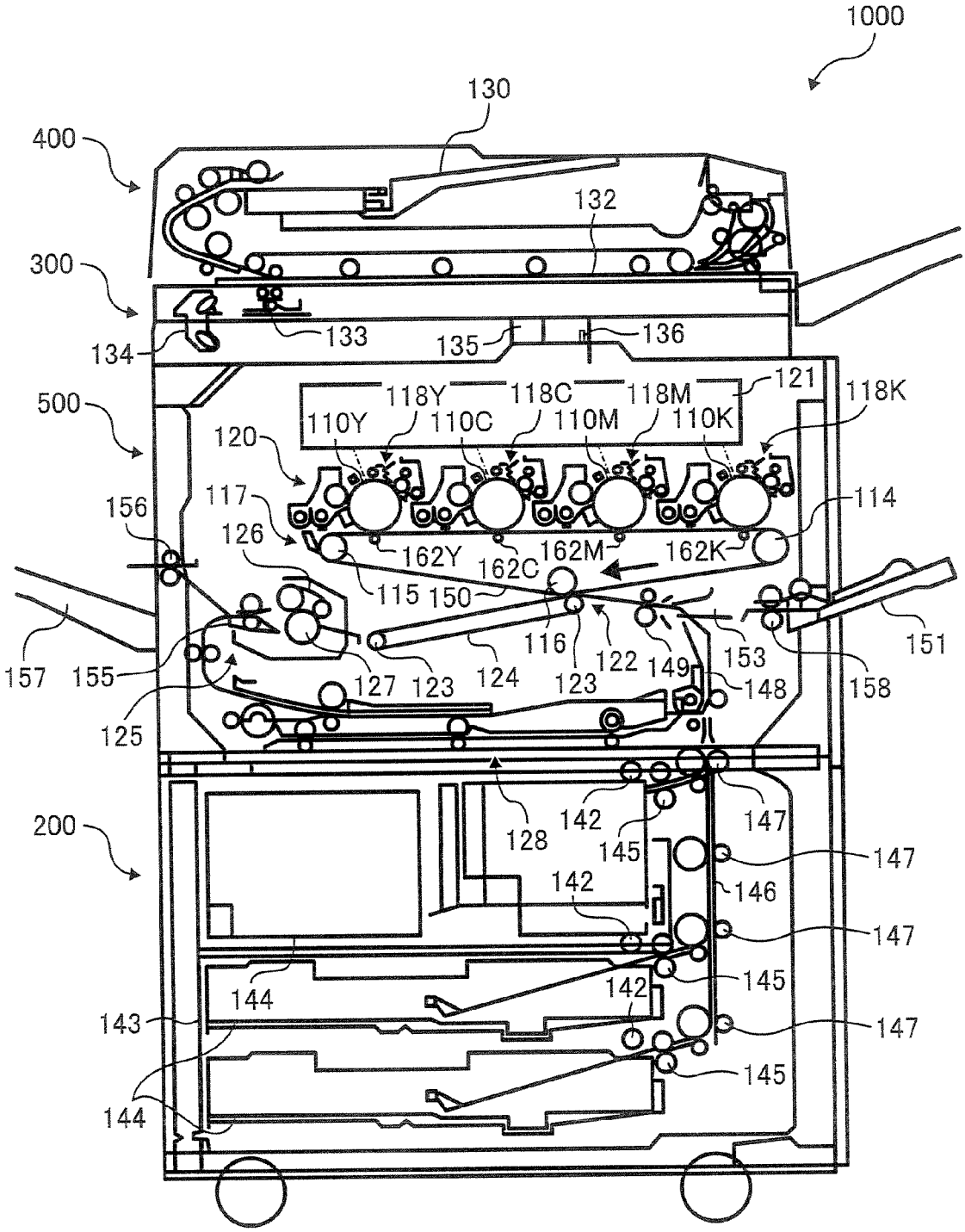
FIG. 5 is a schematic view illustrating another embodiment of the image forming apparatus of the present invention.

FIG. 5 is a schematic view illustrating another embodiment of the image forming apparatus of the present invention. An image forming apparatus 1000 is a tandem-type color image forming apparatus. The image forming apparatus 1000 includes a main body 500, a paper feeding table 200, a scanner 300 and an automatic document feeder (ADF) 400.

An intermediate transfer medium 150 is arranged in the center of the main body 500. The intermediate transfer medium 150, which is an endless belt, is tightly stretched with support rollers 114, 115 and 116 to rotate in a clockwise direction.

A cleaning device 117, configured to remove residual toner particles remaining on the intermediate transfer medium 150, is arranged close to the support roller 115. A tandem-type image forming device 120 including image forming units 118Y, 118C, 118M and 118K is arranged facing the intermediate transfer medium 150. The image forming units 118Y, 118C, 118M and 118K are arranged in this order around the intermediate transfer medium 150 relative to the rotating direction thereof.

Figure 6:
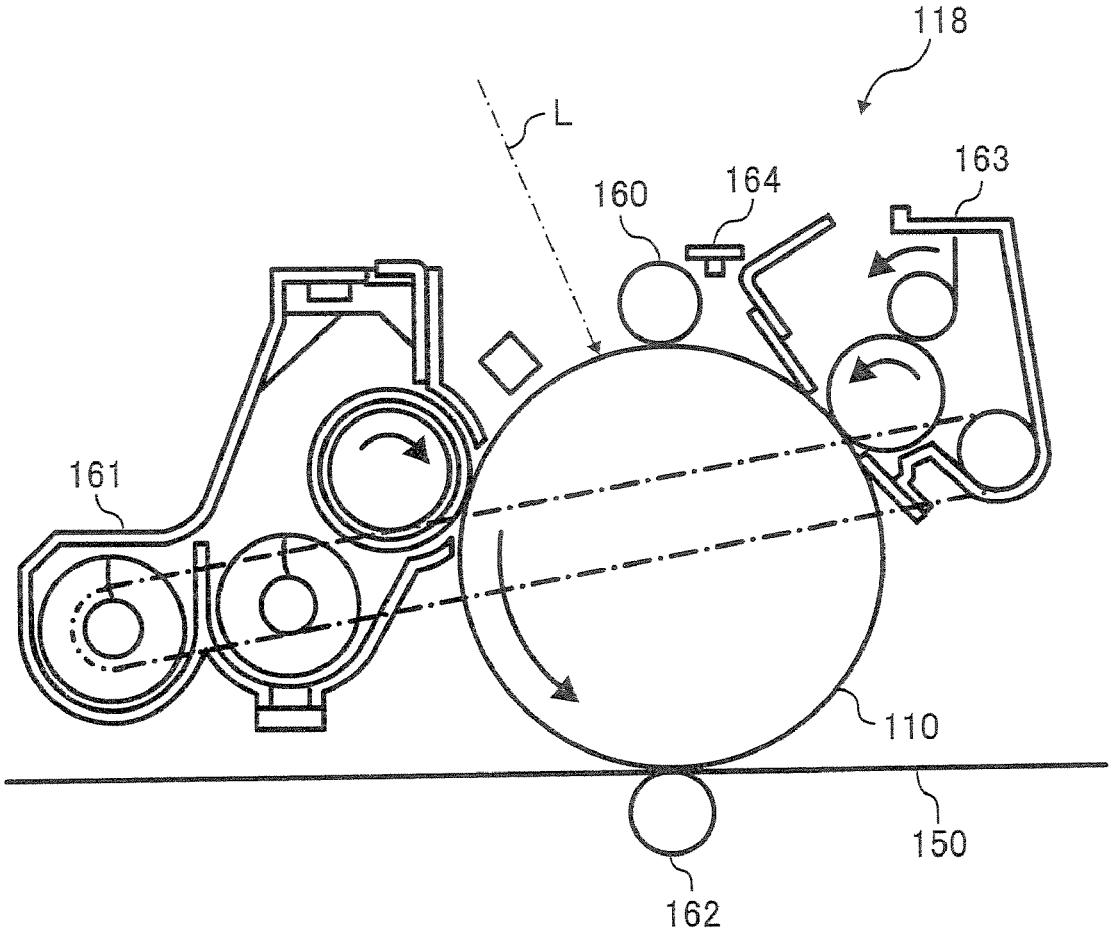
FIG. 6 is a schematic enlarged view partially illustrating an embodiment of the image forming unit of the image forming apparatus illustrated in FIG. 5.

FIG. 6 is a schematic view illustrating an embodiment of the image forming units 118Y, 118C, 118M and 118K. Since the image forming units 118Y, 118C, 118M and 118K have the same configuration, only one image forming unit is illustrated in FIG. 6. Symbols Y, C, M and K, which represent each of the colors, are omitted from the reference number.

The image forming unit 118 includes a photoreceptor 110, a charger 160 configured to uniformly charge the photoreceptor 110, a light irradiator (not shown) configured to form an electrostatic latent image on the photoreceptor 110 by irradiating a light L containing image information corresponding to color information, a developing device 161 configured to form a toner image by developing the electrostatic latent image with a developer including a toner, a transfer charger 162 configured to transfer the toner image to the intermediate transfer medium 150, a cleaning device 163, and a discharging device 264.

A light irradiator 121 is arranged close to the tandem-type image forming device 120. The light irradiator 121 irradiates the image forming device 120 so that an electrostatic latent image is formed on the photoreceptor 10. In FIG. 6, L represents a light emitted by the light irradiator 121.

A secondary transfer device 122 is arranged on the opposite side of the intermediate transfer medium 150 relative to the tandem-type image forming device 120. The secondary transfer device 122 includes a secondary transfer belt 124, which is an endless belt, tightly stretched with a pair of rollers 123. A transfer paper transported on the secondary transfer belt 124 can contact the intermediate transfer medium 150.

A fixing device 125 is arranged close to the secondary transfer device 122. The fixing device 125 includes a fixing belt 126 and a pressing roller 127 configured to press the fixing belt 126.

A reversing device 128 configured to reverse a transfer paper to form images on both sides of the transfer paper is arranged close to the secondary transfer device 122 and the fixing device 125.

Next, a procedure of forming a full color image with the image forming apparatus 1000 will be explained.

An original document is set to a document feeder 130 included in the automatic document feeder (ADF) 400, or placed on a contact glass 132, included in the scanner 300.

When a start switch button (not shown) is pushed, the scanner 300 starts driving, and a first runner 133 and a second runner 134 start moving. When the original document is set to the document feeder 130, the scanner 300 starts driving after the original document is fed on the contact glass 132. The original document is irradiated with a light emitted by a light source via the first runner 133, and the light reflected from the original document is then reflected by a mirror included in the second runner 134. The light passes through an imaging lens 135 and is received by a reading sensor 136. Thus, image information of each color is read.

The light irradiator 121 forms electrostatic latent images on each of the photoreceptors 110 of the tandem-type developing device 120 based on image information of each color. Each of the electrostatic latent images is developed with each of the developing devices 161. Thus, single-color toner images are formed.

The thus prepared single-toner image formed on the photoreceptor 110 of each color is transferred onto the intermediate transfer medium 150, which is rotated by support rollers 114, 115, and 116, one by one (i.e., a primary transfer). Thus, a full-color image is formed on the intermediate transfer medium 150.

On the other hand, in the paper feeding table 200, a recording paper is fed from one of multistage paper feeding cassettes 144, included in a paper bank 143, by rotating one of paper feeding rollers 142. The recording paper is separated by separation rollers 145 and fed to a paper feeding path 146. Then the recording paper is transported to a paper feeding path 148, included in the main body 500, by transport rollers 147, and is stopped by a registration roller 149. When the recording paper is fed from a manual paper feeder 151, the recording paper is separated by a separation roller 158 and fed to a manual paper feeding path 153, and is stopped by the registration roller 149.

The registration roller 149 is typically grounded, however, a bias can be applied thereto in order to remove a paper powder.

The recording paper is timely fed to an area formed between the intermediate transfer medium 150 and the secondary transfer device 122, by rotating the registration roller 149, to meet the full-color toner image formed on the intermediate transfer medium 150. The full-color toner image is transferred onto the recording material in the secondary transfer device 122 (secondary transfer).

The recording paper having the toner image thereon is transported from the secondary transfer device 122 to the fixing device 125. The toner image is fixed on the recording paper upon application of heat and pressure thereto in the fixing device 125. The recording paper is switched by a switch pick 155 and ejected by an ejection roller 156 and then stacked on an ejection tray 157. When the recording paper is switched by the switch pick 155 to be reversed in the reverse device 128, the recording paper is fed to a transfer area again in order to form a toner image on the backside thereof. And then the recording paper is ejected by the ejection roller 156 and stacked on the ejection tray 157.

Toner particles remaining on the intermediate transfer medium 150 are removed with the cleaning device 17.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Unmodified Polyester (Low Molecular Weight Polyester)

The following components were fed in a reaction vessel equipped with a condenser, a stirrer, and a nitrogen inlet pipe.

| | |
|---|---|
| Ethylene oxide (2 mole) adduct of bisphenol A | 67 parts |
| Propylene oxide (3 mole) adduct of bisphenol A | 84 parts |
| Terephthalic acid | 274 parts |
| Dibutyltin oxide | 2 parts |

The mixture was reacted for 8 hours at 230° C. under normal pressure. Then the reaction was further continued for 5 hours under a reduced pressure of 10 to 15 mmHg. Thus, an unmodified polyester was prepared.

The unmodified polyester had a number average molecular weight (Mn) of 2,100, a weight average molecular weight (Mw) of 5,600, a glass transition temperature (Tg) of 55° C.

Preparation of Master Batch

The following components were mixed with a HENSCHEL MIXER (manufactured by Mitsui Mining Co., Ltd.).

| | |
|---|---|
| Water | 1000 parts |
| Carbon black (PRINTEX 35 from Degussa AG, DBP absorption value of 42 ml/100 g, pH of 9.5) | 540 parts |
| Unmodified polyester | 1200 parts |

The mixture was kneaded for 30 minutes at 150° C. with a two-roll mill, and then subjected to rolling and cooling. The rolled mixture was pulverized using a pulverizer (manufactured by Hosokawa Micron Corporation). Thus, a master batch was prepared.

Preparation of Prepolymer

The following components were fed in a reaction vessel equipped with a condenser, a stirrer, and a nitrogen inlet pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 8 hours at 230° C. under normal pressure. Then the reaction was further continued for 5 hours under a reduced pressure of 10 to 15 mmHg. Thus, an intermediate polyester was prepared.

The intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl value of 49 mgKOH/g.

In a reaction vessel equipped with a condenser, a stirrer, and a nitrogen inlet pipe, 411 parts of the intermediate polyester, 89 parts of isophorone diisocyanate, and 500 parts of ethyl acetate were mixed and the mixture was heated for 5 hours at 100° C. to perform the reaction. Thus, a prepolymer (i.e., a polymer capable of reacting with an active hydrogen group) was prepared.

The content of free isocyanate in the prepolymer was 1.60% by weight. The prepolymer included a solid content in an amount of 50% by weight (after being allowed to settle for 45 minutes at 150° C.).

Synthesis of Ketimine (Compound Having Active Hydrogen Group)

In a reaction vessel equipped with a stirrer and a thermometer, 30 parts of isophorone diamine and 70 parts of methyl ethyl ketone were mixed and reacted for 5 hours at 50° C. to prepare a ketimine compound (i.e., a compound having an active hydrogen group).

The ketimine compound had an amine value of 423 mgKOH/g.

Preparation of Toner Constituent Mixture Liquid

In a beaker, 10 parts of the prepolymer, 60 parts of the unmodified polyester, 130 parts of ethyl acetate, and 30 parts of a silicone resin (1) (DOW CORNING® 220 FLAKE RESIN from Dow Corning Toray Co., Ltd.) were added and mixed. Further, 10 parts of a carnauba wax (having a molecular weight of 1,800, an acid value of 2.5 mgKOH/g, and a penetration of 1.5 mm at 40° C.) and 10 parts of the master batch were added thereto. The mixture was subjected to a dispersion treatment using a bead mill (ULTRAVISCOMILL™ from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 2.7 parts of the ketimine compound were added thereto. Thus, a toner constituent mixture liquid was prepared.

Preparation of Water Phase 306 parts of ion-exchange water, 265 parts of a 10% by weight of suspension liquid of tricalcium phosphate, and 0.2 parts of sodium dodecylbenzenesulfonate were mixed and agitated. As a result, a water phase was prepared.

Emulsification or Dispersion

In a vessel, 150 parts of the water phase were added and agitated with a TK HOMOMIXER at a revolution of 12,000 rpm. Next, 100 parts of the toner constituent mixture liquid were added thereto, and then mixed for 10 minutes. Thus, an emulsion or a dispersion (i.e., an emulsion slurry) was prepared.

Solvent Removal

In a conical flask equipped with a stirrer and a thermometer, 100 parts of the emulsion slurry were added, and agitated for 12 hours at 30° C. at a revolution of 20 m/min to remove the organic solvent (i.e., ethyl acetate) therefrom. Thus, a dispersion slurry was prepared.

Washing and Drying

One hundred (100) parts of the dispersion slurry was filtered under a reduced pressure.

The thus obtained wet cake was mixed with 100 parts of ion-exchange water and the mixture was agitated for 10 minutes with a TK HOMOMIXER at a revolution of 12,000 rpm, followed by filtering. Thus, a wet cake (i) was prepared.

The wet cake (i) was mixed with 300 parts of ion-exchange water and the mixture was agitated for 10 minutes with a TK HOMOMIXER at a revolution of 12,000 rpm, followed by filtering. This operation was performed twice. Thus, a wet cake (ii) was prepared.

The wet cake (ii) was mixed with 20 parts of a 10% aqueous solution of sodium hydroxide and the mixture was agitated for 30 minutes with a TK HOMOMIXER at a revolution of 12,000 rpm, followed by filtering under a reduced pressure. Thus, a wet cake (iii) was prepared.

The wet cake (iii) was mixed with 300 parts of ion-exchange water and the mixture was agitated for 10 minutes with a TK HOMOMIXER at a revolution of 12,000 rpm, followed by filtering. This operation was performed twice. Thus, a wet cake (iv) was prepared.

The wet cake (iv) was mixed with 20 parts of a 10% aqueous solution of hydrochloric acid and the mixture was agitated for 10 minutes with a TK HOMOMIXER at a revolution of 12,000 rpm, followed by filtering. Thus, a wet cake (v) was prepared.

The wet cake (v) was mixed with 300 parts of ion-exchange water and the mixture was agitated for 10 minutes with a TK HOMOMIXER at a revolution of 12,000 rpm, followed by filtering. This operation was performed twice. Thus, a wet cake (vi) was prepared.

The wet cake (vi) was dried for 48 hours at 45° C. using a circulating air drier, followed by sieving with a screen having openings of 75 μm. Thus, a mother toner (1) was prepared.

Example 2

The procedure for preparation of the mother toner (1) in Example 1 was repeated except that the added amount of the silicone resin (1) was changed from 30 parts to 15 parts. Thus, a mother toner (2) was prepared.

Example 3

The procedure for preparation of the mother toner (1) in Example 1 was repeated except that the silicone resin (1) was replaced with a styrene-acrylic copolymer resin (1) (FCA-1001-NS from Fujikura Kasei Co., Ltd.). Thus, a mother toner (3) was prepared.

Example 4

The procedure for preparation of the mother toner (3) in Example 3 was repeated except that the added amount of the styrene-acrylic copolymer (1) was changed from 30 parts to 15 parts. Thus, a mother toner (4) was prepared.

Example 5

The procedure for preparation of the mother toner (1) in Example 1 was repeated except that the silicone resin (1) was replaced with a styrene-acrylic copolymer resin (2) (FCA-207P from Fujikura Kasei Co., Ltd.). Thus, a mother toner (5) was prepared.

Example 6

The procedure for preparation of the mother toner (1) in Example 1 is repeated except that 1200 parts of the unmodified polyester used for the master batch are replaced with a combination of 1000 parts of the unmodified polyester and 200 parts of the silicone resin (1). Thus, a mother toner (6) is prepared.

In this case, the carbon black is included in both the unmodified polyester phase and the silicone resin (1) phase in the master batch. As a result, the carbon black is included in both the unmodified polyester phase and the silicone resin (1) phase also in the resultant toner.

Example 7

The procedure for preparation of the mother toner (1) in Example 1 is repeated except that the process of "preparation of toner constituent mixture liquid" was changed as follows. Thus, a mother toner (7) is prepared.

Preparation of Toner Constituent Mixture Liquid

In a beaker, 130 parts of ethyl acetate and 30 parts of a silicone resin (1) (DOW CORNING® 220 FLAKE RESIN from Dow Corning Toray Co., Ltd.) are mixed and agitated. Further, 10 parts of a carnauba wax (having a molecular weight of 1,800, an acid value of 2.5 mgKOH/g, and a penetration of 1.5 mm at 40° C.) are added thereto. The mixture is subjected to a dispersion treatment using a bead mill (ULTRAVISCOMILL™ from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a wax dispersion (1) is prepared.

Next, 10 parts of the prepolymer, 60 parts of the unmodified polyester, 10 parts of the master batch, and 2.7 parts of the ketimine compound are added to the wax dispersion (1) and agitated. Thus, a toner constituent mixture liquid is prepared.

In this case, the wax is selectively included in the silicone resin phase.

Example 8

Preparation of Styrene-acrylic Copolymer Resin

In a reaction vessel equipped with a condenser, a stirrer, and a nitrogen inlet pipe, 300 parts of ethyl acetate, 300 parts of a mixture (3) of styrene-acrylic monomers (components are described in Table 1), and 5 parts of azobis isobutyl nitrile were added and reacted for 6 hours at 60° C. under normal pressure of nitrogen atmosphere. Next, 200 parts of methanol was added thereto, and then agitated for 1 hour. A supernatant liquid was removed therefrom, and then the product was dried under a reduced pressure. Thus, a styrene-acrylic copolymer resin (3) was prepared.

Preparation of Mother Toner

The procedure for preparation of the mother toner (1) in Example 1 was repeated except that the silicone resin (1) was replaced with the styrene-acrylic copolymer resin (3). Thus, a mother toner (8) was prepared.

Example 9

Preparation of Styrene-acrylic Copolymer Resin

The procedure for preparation of the styrene-acrylic copolymer resin (3) in Example 8 was repeated except that the mixture (3) of styrene-acrylic monomers was replaced with a mixture (4) of styrene-acrylic monomers (components are described in Table 1). Thus, a styrene-acrylic copolymer resin (4) was prepared.

Preparation of Mother Toner

The procedure for preparation of the mother toner (1) in Example 1 was repeated except that the silicone resin (1) was replaced with the styrene-acrylic copolymer resin (4). Thus, a mother toner (9) was prepared.

Comparative Example 1

The procedure for preparation of the mother toner (1) in Example 1 was repeated except the silicone resin (1) was not added. Thus, a comparative mother toner (C1) was prepared.

Comparative Example 2

The procedure for preparation of the comparative mother toner (C1) in Comparative Example 1 was repeated. The thus prepared aqueous solution of the mother toner (C1) was successively mixed with a monomer mixture including 3.1 parts of butyl acrylate and 6.9 parts of methyl methacrylate, 1.4 parts of a 4% aqueous solution of ammonium persulfate (APS), and 1.4 parts of a 4% aqueous solution of sodium metabisulfite (SMBS), and then reacted for about 5 hours at 80° C. The mixture was subjected to a solid-liquid separation, and then the solid content was washed with diluted hydrochloric acid and diluted water in this order and dried. Thus, a comparative mother toner (C2) having a core-shell structure was prepared.

Comparative Example 3

The procedure for preparation of the mother toner (1) in Example 1 was repeated except that the silicone resin (1) was replaced with a silicone resin (2) (SIIRES® 604 from Wacker Asahikasei Silicone Co., Ltd.). Thus, a comparative mother toner (C3) was prepared.

Comparative Example 4

The procedure for preparation of the mother toner (1) in Example 1 was repeated except that the silicone resin (1) was replaced with a silicone resin (3) (SIIRES® 610 from Wacker Asahikasei Silicone Co., Ltd.). Thus, a comparative mother toner (C4) was prepared.

Comparative Example 5

Preparation of Styrene-acrylic Copolymer Resin

The procedure for preparation of the styrene-acrylic copolymer resin (3) in Example 8 was repeated except that the mixture (3) of styrene-acrylic monomers was replaced with a mixture (5) of styrene-acrylic monomers (components are described in Table 1). Thus, a styrene-acrylic copolymer resin (5) was prepared.

Preparation of Mother Toner

The procedure for preparation of the mother toner (1) in Example 1 was repeated except that the silicone resin (1) was replaced with the styrene-acrylic copolymer resin (5). Thus, a comparative mother toner (C5) was prepared.

TABLE 1

| Styrene-acrylic copolymer | Monomer components (% by weight) St | 2EHA | MA | 2HEA | Weight average molecular weight (Mw) | Glass transition temperature (Tg)(° C.) |
|---|---|---|---|---|---|---|
| (3) | 75 | 15 | 5 | 5 | 16,000 | 57 |
| (4) | 75 | 15 | 10 | 0 | 15,000 | 65 |
| (5) | 40 | 50 | 10 | 0 | 13,000 | 53 |

The abbreviated names of the monomers are as follows.
St: Styrene
2EHA: 2-Ethylhexyl acrylate
MA: Methacrylic acid
2HEA: 2-Hydroxyethyl acrylate External Treatment One hundred (100) parts of each of the above prepared mother toners (1) to (9) and comparative mother toners (C1) to (C5) is respectively mixed with 1.0 part of a hydrophobized silica (H2000 from Clariant Japan K.K.) using a HENSCHEL MIXER (from Mitsui Mining Co., Ltd.) for 30 seconds at a revolution of 30 m/sec, followed by pause for 1 minute. This mixing operation is repeated for 5 times. The mixture is sieved with a screen having openings of 35 μm. Thus, toners (1) to (9) and comparative toners (C1) to (C5) are prepared.

Preparation of Carrier

At first, 100 parts of toluene, 100 parts of a silicone resin (organo-straight silicone), 5 parts of r-(2-aminoethyl)aminopropyltrimethoxysilane, and 10 parts of a carbon black are mixed and agitated for 20 minutes using a HOMOMIXER, to prepare a cover layer forming liquid. The cover layer forming liquid is coated on the surfaces of 1,000 parts of a particulate magnetite having a particle diameter of 50 μm using a fluidized-bed coating machine. Thus, a magnetic carrier is prepared.

Preparation of Two-component Developer

Five parts of each of the above-prepared toners (1) to (9) and comparative toners (C1) to (C5) is respectively mixed with 95 parts of the magnetic carrier using a ball mill. Thus, two-component developers are prepared.

Evaluations of Compatibility Between Two Resins

In order to evaluate the compatibility between the first and second binder resins in a solvent, 50 parts of the unmodified polyester resin (i.e., the first binder resin) and 50 parts of each of the added resin (i.e., the second binder resin) were mixed and evenly ground with a mortar, and then the mixture was dissolved in ethyl acetate in a glass vessel so that the resultant resin solution had a concentration of 50% by weight. A proper amount of zirconium beads was added to the resin solution, and then the resin solution was agitated for 10 hours using a paint shaker. The resin solution was added to a quartz cell and subjected to a measurement of transmittance at a wavelength of 550 nm.

On the other hand, the resin solution had been allowed to settle for 15 hours to evaluate the phase separation state with time. The phase separation state in a solvent was evaluated as follows.

Compatible: The resin solution was even and a clear interface was not observed therein even after being subjected to the settlement.

Separate: The two resins were phase separated and an interface was observed between the upper and lower phases of the resin solution after being subjected to the settlement.

Next, the resin solution was applied to an overhead projection (OHP) sheet using a wire bar having a diameter of 0.05 mm, and then dried to remove the organic solvent therefrom. In order to evaluate the compatibility between the first and second binder resins without a solvent, the OHP sheet applied the resins was observed with an optical microscope. The phase separation state without a solvent was evaluated as follows.

Compatible: A clear sea-island structure of two resins was not observed.

Separate: A sea-island structure of two resins was observed.

Evaluations of Mother Toners

The above-prepared mother toners were subjected to observations using an optical microscope and a transmission electron microscope (TEM) to evaluate the toner shapes. The toner shapes were categorized into the embodiments illustrated in FIGS. 1A to 1E. The exposure ratio of the first binder resin (i.e., mother particle) was determined from the cross section image obtained by the TEM observation.

The evaluation results of the compatibility between the two resins and the mother toners are shown in Table 2.

TABLE 2

| | Compatibility | | | Mother toner | | | |
|---|---|---|---|---|---|---|---|
| | Phase separation state (in a solvent) | Phase separation state (without a solvent) | Transmittance (%) | Toner shape (FIG.) | Exposure ratio of first binder resin | 1a(av)/L | 1b(av)/L |
| Ex. 1 | Separate | Separate | 50 | 1B | 70 | 0.3 | 0.7 |
| Ex. 2 | Separate | Separate | 50 | 1E | 35 | 0.03 | 0.05 |
| Ex. 3 | Separate | Separate | 24 | 1B | 60 | 0.4 | 0.6 |
| Ex. 4 | Separate | Separate | 24 | 1E | 30 | 0.1 | 0.08 |
| Ex. 5 | Separate | Separate | 50 | 1E | 30 | 0.06 | 0.04 |
| Ex. 6 | Separate | Separate | 50 | 1E | 30 | 0.08 | 0.06 |
| Ex. 7 | Separate | Separate | 17 | 1B | 55 | 0.04 | 0.05 |
| Ex. 8 | Compatible | Separate | 91 | 1A | 0 | 0 | 1 |
| Ex. 9 | Compatible | Separate | 85 | 1A | 0 | 0 | 1 |
| Comp. Ex. 1 | — | — | — | 1D | 100 | 1 | 0 |
| Comp. Ex. 2 | — | — | — | 1A | 0 | 0 | 1 |
| Comp. Ex. 3 | Compatible | Compatible | 88 | 1D | 100 | 1 | 0 |
| Comp. Ex. 4 | Compatible | Compatible | 4 | 1C | 100 | 1 | 0 |
| Comp. Ex. 5 | Compatible | Compatible | 92 | 1D | 100 | 1 | 0 |

Evaluations of Two-component Developers

The above-prepared two-component developers are subjected to the following evaluations.

(1) Transfer Rate (%)

A two-component developer is set in an image forming apparatus (MF2800 manufactured by Ricoh Co., Ltd.), and then a black solid image (having an image density of not less than 1.38, when measured by a Macbeth densitometer) having a size of 15 cm×15 cm is produced. The transfer rate (%) is calculated from the following equation:

$$R(\%)=(Tr/Tp)\times 100$$

wherein R represents a transfer rate, Tr represents an amount of a toner transferred onto a recording medium, and Tp represents an amount of a toner developed on a photoreceptor.

The transfer rate is graded as follows.

Very good: not less than 90%

Good: not less than 80% and less than 90%

Average: not less than 70% and less than 80%

Poor: less than 70%

(2) Transfer Unevenness

The black solid images, prepared in the above evaluation of (2) transfer rate, are visually observed to evaluate the transfer unevenness. The transfer unevenness is graded as follows.

Very good: Transfer unevenness is not observed. The image is very even.

Good: Transfer unevenness is observed. No problem in practical use.

Average: Transfer unevenness is slightly observed. No problem in practical use.

Poor: Transfer unevenness is observed. Having problem in practical use.

(3) Minimum Fixable Temperature (Low-Temperature Fixability)

A two-component developer is set in a modified copier (MF200 manufactured and modified by Ricoh Co., Ltd.) including a fixing roller using TEFLON®. Images are formed on copying paper (TYPE 6200 from Ricoh Co., Ltd.) and fixed at various temperatures to determine the minimum fixable temperature below which the residual rate of the image density was less than 70% when the fixed image was rubbed with a pad. The minimum fixable temperature is graded as follows.

Very good: less than 120° C.

Good: less than 140° C. and not less than 120° C.

Average: less than 160° C. and not less than 140° C.

Good: not less than 160° C.

(4) Hot Offset Temperature (Hot Offset Resistance)

A two-component developer is set in a modified tandem-type full-color copier (IMAGIO NEO C350 manufactured and modified by Ricoh Co., Ltd.) of which a silicone oil applicator is detached from the fixing unit so as to perform oilless fixing. The above copier is also modified so that the fixing temperature and the linear speed can be variable. Solid images having 0.82 to 0.88 mg/cm$^2$ of a toner is produced on plain paper and fixed at various temperatures to determine the temperature at which the hot offset occurs. The hot offset occurrence temperature is graded as follows.

Very good: not less than 210° C.

Good: less than 210° C. and not less than 190° C.

Average: less than 190° C. and not less than 170° C.

Poor: less than 170° C.

(5) Coloring Power

A two-component developer is set in a tandem-type full-color copier (IMAGIO NEO 450 from Ricoh Co., Ltd.). A solid image having 0.95 to 1.05 mg/cm$^2$ of a toner is produced and fixed on copying paper (TYPE 6000 <70W> from Ricoh Co., Ltd.) at a fixing roller temperature of from 158 to 162° C. The image density of the produced solid image is determined by averaging image densities of six randomly selected portions of the solid image measured with X-RITE 938 (from X-rite Inc.). The coloring power is evaluated by the image density, which is graded as follows.

Good: not less than 2.0

Average: not less than 1.7 and less than 2.0

Poor: less than 1.7

(8) Cleanability

A two-component developer is set in the tandem-type full-color copier (IMAGIO NEO 450 from Ricoh Co., Ltd.) used for the above evaluation of (5) image density. Then 1,000 sheets of a chart having an image proportion of 95% are produced. Residual toner particles, remaining on the surface of the photoreceptor even after the photoreceptor is cleaned, are transferred onto a white paper together with a tape (SCOTCH® from Sumitomo 3M). The image density of the transferred toner particles on the white paper is measured with a Macbeth reflective densitometer RD514. The cleanability is evaluated by the image density, which is graded as follows.

Good: less than 0.010

Average: not less than 0.011 and less than 0.020

Poor: not less than 0.020

The evaluation results of the developers are shown in Table 3.

TABLE 3

| | Transferability | | Fixability | | | | | |
|---|---|---|---|---|---|---|---|---|
| | Transfer rate (%) | Transfer unevenness | Minimum fixable temp. (° C.) | Hot offset temp. (° C.) | Coloring power | Fogging | Thermostable preserveability | Cleanability |
| Ex. 1 | Good | Good | Good | Good | Good | Good | Good | Good |
| Ex. 2 | Very good | Very good | Good | Good | Good | Good | Very good | Good |
| Ex. 3 | Good | Good | Good | Good | Good | Good | Good | Good |
| Ex. 4 | Very good | Very good | Good | Good | Good | Good | Very good | Good |
| Ex. 5 | Very good | Very good | Good | Good | Good | Good | Very good | Good |
| Ex. 6 | Good | Good | Good | Good | Good | Good | Good | Good |
| Ex. 7 | Good | Good | Good | Very good | Good | Good | Good | Good |
| Ex. 8 | Good | Good | Good | Good | Good | Good | Good | Average |
| Ex. 9 | Good | Good | Average | Good | Good | Good | Very good | Average |
| Comp. Ex. 1 | Average | Average | Good | Good | Good | Poor | Good | Poor |
| Comp. Ex. 2 | Average | Average | Poor | Average | Average | Good | Very good | Poor |
| Comp. Ex. 3 | Average | Average | Good | Good | Average | Poor | Average | Poor |
| Comp. Ex. 4 | Poor | Poor | Good | Average | Poor | Poor | Average | Poor |
| Comp. Ex. 5 | Average | Average | Average | Average | Average | Poor | Good | Poor |

(6) Fogging

A two-component developer is set in the above tandem-type full-color copier (IMAGIO NEO 450 from Ricoh Co., Ltd.) including a cleaning blade and a charging roller, which contact a photoreceptor. After 10,000 sheets of an image pattern A, in which a black solid image and a white solid image are repeatedly formed at intervals of 1 cm on a laterally-faced A4-size paper in vertical direction to the rotating direction of the developing sleeve are produced, a white blank image is produced. The white blank image is visually observed whether fogging occurs or not. The fogging is evaluated as follows.

Good: No fogging is observed.

Poor: Fogging is observed.

(7) Thermostable Preservability (Penetration)

A 50 ml glass container is filled with a toner. The glass container containing the toner is put in a thermostatic chamber for 24 hours at 50° C., and then cooled to 24° C. The toner is subjected to a penetration test (based on JIS K2235-1991). Thermostable preservability is evaluated by penetration (mm), which is graded as follows. A toner having a penetration of less than 5 mm has a problem in practical use.

Very good: not less than 25 mm

Good: not less than 15 mm and less than 25 mm

Average: not less than 5 mm and less than 15 mm

Poor: less than 5 mm

It is clear from Table 3 that each of the toners of Examples 1 to 9 has a good combination of transferability, fixability, coloring power, image quality, thermostable preservability, and cleanability.

In the toners of Examples 1 to 4, the resin phase including the colorant and the resin phase including no colorant are phase separated. Such a toner can produce high quality images having high image density even if the amount of the toner present on a recording medium is small. In addition, such a toner has a stable chargeability even if the amount of the colorant is increased in the toner, and therefore high quality images without fogging can be produced. Moreover, these toners have good transferability because of having reasonably irregular shapes.

The toners of Examples 2, 4, and 5 have projections. The projections function as spacers, and therefore these toners have a good combination of transferability and thermostable preservability.

In the toner of Example 7, the wax is selectively included in the second binder resin phase, and therefore the toner has good hot offset resistance.

The toners of Examples 8 and 9 have a core-shell structure. Since the shapes thereof are nearly spherical, cleanability is on the average level, but the other evaluations show good results.

On the other hand, the toner of Comparative Example 1 includes the first binder resin but does not include the second binder resin. In this case, the toner has good coloring power, but the colorant deteriorates chargeability thereof. As a result, fogging is observed in the resultant images. Since the shape thereof is nearly spherical, both transferability and cleanability are poor.

The toner of Comparative Example 2 can produce high quality images. However, the toner has a nearly spherical shape because a resin layer is formed on the mother particle, and therefore the toner has poor cleanability. Since the resin layer (i.e., shell) has high thermal property, low-temperature fixability is poor.

In the toner of Comparative Example 4, resin particles including the colorant and resin particles including no colorant are separately produced. Therefore, the toner has uneven chargeability and produces fogged images. The toner also has poor transferability, cleanability, thermostable preservability, and coloring power.

In the toners of Comparative Examples 3 and 5, the first and second binder resins are compatible in the toner, and a phase separation structure is not formed therein. In this case, functions of the first and second binder resins are not separated, and therefore the toner cannot have various toner properties at the same time.

This document claims priority and contains subject matter related to Japanese Patent Applications Nos. 2005-361882 filed on Nov. 15, 2005, 2006-229027 filed on Aug. 25, 2006, 2006-241848 filed on Sep. 6, 2006, and 2006-337790 filed on Dec. 15, 2006, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a colorant;

a first binder resin; and a second binder resin, wherein an amount of the first binder resin and an amount of the second binder resin are phase separated from each other in the toner, wherein a phase of the first binder resin is partially covered with a phase of the second binder resin, wherein the surface of the toner comprises:

the first binder resin forming a mother particle; and the second binder resin forming discontinuous and independent projections on the mother particle, and wherein the first binder resin has an exposure ratio (R) of from 20 to 70% when determined by the following formula:

$$R=(La/L)\times 100$$

wherein R represents the exposure ratio of the first binder resin, La represents a sum of lengths of exposed portions of the first binder resin, and L represents a circumferential length of the toner, which are determined from a cross-sectional image of the toner obtained by a transmission electron microscope (TEM).

2. The toner according to claim 1, wherein the toner is prepared by a method comprising:

dissolving or dispersing toner constituents comprising the colorant, the first binder resin, and the second binder resin in an organic solvent to prepare a toner constituent solution or dispersion; and emulsifying or dispersing the toner constituent solution or dispersion in an aqueous medium to prepare an emulsion or a dispersion comprising the toner.

3. The toner according to claim 1, wherein the toner has a core-shell structure comprising:

a core consisting essentially of the first binder resin; and a shell consisting essentially of the second binder resin, wherein the first binder resin and the second binder resin form a single phase when dissolved in an organic solvent at the same mixing ratio as the toner, while incompatible with each other when the organic solvent is removed therefrom.

4. The toner according to claim 2, wherein the toner constituents further comprise:

a compound having an active hydrogen group; and a polymer capable of reacting with the active hydrogen group, wherein the compound and the polymer are subjected to a reaction to produce an adhesive base material.

5. The toner according to claim 1, wherein the following relationships are satisfied:

$$0.01<la(av)/L<0.3$$

$$0.01<lb(av)/L<0.5$$

wherein la(av) represents an average length of exposed portions of the first binder resin, lb(av) represents an average length of exposed portions of the second binder resin, and L represents a circumferential length of the toner, which are determined from a cross-sectional image of the toner obtained by a transmission electron microscope (TEM).

6. The toner according to claim 1, wherein the projection has a height of from 0.1 to 2 μm measured from the surface of the mother particle.

7. The toner according to claim 1, wherein a solution in which the same amount of the first binder resin and the second binder resin are dissolved in an organic solvent, and having a concentration of 50% by weight, has a transmittance of from 0 to 70% at a wavelength of 550 nm when agitated for 10 hours with a paint shaker.

8. The toner according to claim 1, wherein the phase of the first binder resin comprises the colorant while the phase of the second binder resin comprises no colorant.

9. The toner according to claim 1, wherein the second binder resin has a charging ability larger than the first binder resin.

10. The toner according to claim 1, wherein the toner comprises the first binder resin in an amount of from 50 to 95% by weight based on total weight of the toner.

11. The toner according to claim 1, wherein the toner comprises the second binder resin in an amount of from 5 to 50% by weight based on total weight of the toner.

12. The toner according to claim 1, wherein the toner has an average circularity of from 0.920 to 0.970.

13. The toner according to claim 1, wherein the first binder resin has a polyester skeleton.

14. The toner according to claim 1, wherein the second binder resin has a silicone skeleton.

15. The toner according to claim 1, wherein the second binder resin has a styrene-acrylic skeleton.

16. A method of preparing the toner according to claim 1, comprising:

dissolving or dispersing toner constituents comprising a colorant and two or more binder resins in an organic solvent to prepare a toner constituent solution or dispersion; and emulsifying or dispersing the toner constituent solution or dispersion in an aqueous medium to prepare an emulsion or a dispersion containing the toner.

17. A developer, comprising the toner according to claim 1 and a carrier.

18. An image forming method, comprising:

forming an electrostatic latent image on an image bearing member;

developing the electrostatic latent image with a toner to form a toner image on the image bearing member;

transferring the toner image onto a recording medium; and fixing the toner image on the recording medium, wherein the toner is the toner according to claim 1.

19. An image forming apparatus, comprising:

an image bearing member configured to bear an electrostatic latent image;

an electrostatic latent image forming device configured to form an electrostatic latent image on the image bearing member;

a developing device configured to develop the electrostatic latent image with a toner to form a toner image on the image bearing member;

a transfer device configured to transfer the toner image onto a recording medium; and a fixing device configured to fix the toner image on the recording medium, wherein the toner is the toner according to claim 1.

20. A process cartridge, comprising:

an image bearing member configured to bear an electrostatic latent image; and a developing device configured to develop the electrostatic latent image with a toner to form a toner image, wherein the toner is the toner according to claim 1.

* * * * *